US007226717B2

(12) United States Patent
Nakamura et al.

(10) Patent No.: US 7,226,717 B2
(45) Date of Patent: Jun. 5, 2007

(54) RESIN COMPOSITION

(75) Inventors: Ippei Nakamura, Shizuoka-ken (JP); Akihiro Endo, Shizuoka-ken (JP)

(73) Assignee: Fujifilm Corporation, Tokyo (JP)

( * ) Notice: Subject to any disclaimer, the term of this patent is extended or adjusted under 35 U.S.C. 154(b) by 347 days.

(21) Appl. No.: 10/618,068

(22) Filed: Jul. 14, 2003

(65) Prior Publication Data

US 2004/0014831 A1 Jan. 22, 2004

(30) Foreign Application Priority Data

Jul. 12, 2002 (JP) ..... 2002-204418

(51) Int. Cl.
*G03C 1/00* (2006.01)

(52) U.S. Cl. ..... 430/270.1; 430/325; 430/326; 430/170; 430/330; 430/54; 430/921

(58) Field of Classification Search ..... 430/270.1, 430/325, 326, 170, 330, 54, 921
See application file for complete search history.

(56) References Cited

U.S. PATENT DOCUMENTS 4,436,805 A * 3/1984 Iguchi et al. ..... 430/248

FOREIGN PATENT DOCUMENTS

| | | | |
|---|---|---|---|
| JP | 54-092526 | * | 7/1979 |
| JP | 07-285275 A | | 10/1995 |
| JP | 11-020318 | * | 1/1999 |
| JP | 2000-241966 A | | 9/2000 |

* cited by examiner

*Primary Examiner*—Ling-Siu Choi
(74) *Attorney, Agent, or Firm*—Sughrue Mion, PLLC

(57) ABSTRACT

The present invention relates to a resin composition comprising: an alkali-soluble resin (A); an infrared absorbing agent (B); and a thiol compound (C), wherein a solubility thereof in an alkaline aqueous solution is changed by exposure with a infrared laser ray, and a positive or negative-type image recording layer containing the resin composition.

21 Claims, No Drawings

RESIN COMPOSITION

CROSS-REFERENCE TO RELATED APPLICATION

This application claims priority under 35 USC 119 from Japanese patent Application No. 2002-204418, the disclosure of which is incorporated by reference herein.

BACKGROUND OF THE INVENTION

1. Field of the Invention

The present invention relates to a resin composition that alters its solubility in an alkaline aqueous solution by exposure to infrared, and particularly, to a resin composition useful for an image recording layer of positive or negative-type planographic printing plate precursor capable of direct plate-making by scanning with an infrared laser beam based on a digital signal outputted from a computer or the like.

2. Description of the Related Art

Development in laser technology in recent years has been conspicuous, making it possible to easily acquire a solid laser or semiconductor laser having a light emitting region of, especially, from near infrared to infrared with a high output but in a small size. Especially, in the field of planographic printing, the lasers play a very important role as an exposure light source in direct plate-making based on digital data of a computer or the like.

A positive-type planographic printing plate material for infrared laser light in direct plating is disclosed in Japanese Patent Application Laid-Open (JP-A) No. 7-285275. The invention in the publication relates to an image recording material obtained by adding a material absorbing light to generate heat and a positive photosensitive compound such as a quinonediazide compound to an alkali-soluble resin, wherein, in an image portion, the positive photosensitive compound works as a dissolution inhibitor substantially reducing a solubility of the resin soluble in an alkali aqueous solution, while in a non-image portion, the positive photosensitive compound is decomposed by heat so as not to exert a dissolution inhibiting capability and to thereby enabling the resin to be removed in development and an image is formed.

In such a positive-type planographic printing plate material, an example is described in JP-A No. 2000-241966, in which a phenolic hydroxyl group containing compound is added to an alkali-soluble resin for the purpose to improve a removability (solubility) of a non-image portion by an alkali developing solution. However, since this phenolic hydroxyl group containing compound also increases a solubility of an image portion, the technique is still at a level where further improvement is desired with respect to difficulty in attaining a sharp image contrast.

On the other hand, as a negative-type image forming method, there can be cited a recording method in which a condensation cross-linking reaction is caused by a heat treatment after exposure with an acid generated by light or heat as a catalyst to cure a recording layer of an exposed portion and an image portion forms. As a printing plate having such an acid-catalyst cross-linking type recording layer, a technique as described in JP-A No. 7-271029 has been known. Furthermore, a recording method can be cited in which a polymerization reaction is caused with a radical as an initiator generated by light or heat to cure a recording layer of an exposed portion and an image portion forms. As a printing plate having a recording layer polymerized by light or heat, there has been known a technique using a photopolymerizable or heat-polymerizable composition as a recording layer, which is described in JP-A Nos. 8-108621 and 9-34110.

Such a negative-type image recording material is lower in image forming capability compared with a positive type image recording material in which solubilization of a recording layer is caused by energy of infrared laser light irradiation; therefore, it is general to conduct a heat treatment prior to a developing process in order to accelerate a curing reaction through polymerization so as to form a rigid image portion.

SUMMARY OF THE INVENTION

It is an object of the present invention to provide a resin composition useful for a recording layer of a planographic printing plate precursor, capable of direct plate-making based on digital data of a computer or the like, and capable of forming an image excellent in contrast by recording with a solid laser or a semiconductor laser that radiates infrared ray.

The inventors found, as a result of a serious study, that the object is achieved by adding a thiol compound into a resin composition that alters its solubility in an alkaline aqueous solution by exposure with an infrared laser as described above, thereby the invention is achieved.

That is, a resin composition of the invention is characterized by that the composition comprises: an alkali-soluble resin (A); an infrared absorbing agent (B); and a thiol compound (C) and alters its solubility in an alkaline aqueous solution by exposure to infrared laser light.

In the invention, a thiol compound (C) described above is preferably an aromatic thiol compound.

Furthermore, as another preferable aspect, a thiol compound (C) described above is a thiol compound that is tautomerizable as shown by the following general formula (1):

General formula (1)

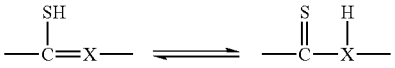

in the general formula (1), X indicates a trivalent atom or atomic group and among them, preferably indicates a nitrogen atom or a methine group (CH), and a nitrogen atom is especially preferable from the viewpoint of easiness to cause tautomerism.

A resin composition of the invention contains a thiol compound as a component, and the thiol compound has characteristics that it is higher in acidity compared with a phenolic hydroxyl group containing compound described above, whereas a degree of polarization in an S—H bond is low. Therefore, it is thought that in the case where a resin composition of the invention is used as a recording layer of a planographic printing plate precursor, infiltration of an alkali developing solution into a coating film formed is suppressed to improve a development resistance in an image portion due to a low degree of polarization in, that is a low hydrophilicity of, an S—H group of a thiol compound in the image portion.

Furthermore, it is thought that in the case where a resin composition of the invention is used as a positive-type planographic printing plate precursor, an alkali aqueous solution infiltrates into a non-image portion having an improved alkali-solubility by exposure in development to dissolve a thiol compound out and the thiol compound works as a dissolution accelerating agent due to its high acidity to improve a developability of the non-image portion and to thereby, obtain an image excellent in discrimination.

The first aspect of the invention is to provide a resin composition (S) comprising:

(A) an alkali-soluble resin;

(B) an infrared absorbing agent; and (C) a thiol compound, wherein a solubility of the resin composition in an alkaline aqueous solution is changed by exposure with an infrared laser beam.

The second aspect of the invention is to provide a resin composition (T) comprising:

(A) an alkali-soluble resin;

(B) an infrared absorbing agent;

(C) a thiol compound; and (D) a compound that are thermally decomposable and substantially reduces a solubility of the alkali-soluble resin in an undecomposed state wherein a solubility of the resin composition in an alkaline aqueous solution is changed by exposure with an infrared laser beam.

The third aspect of the invention is to provide a resin composition (T), wherein the compound that are thermally decomposable and substantially reduces a solubility of the alkali-soluble resin in an undecomposed state is a compound selected from a group consisting of onium salts, o-quinonediazide compounds, and alkyl sulfonate esters.

The fourth aspect of the invention is to provide a resin composition (S), wherein the thiol compound can tautomerize as shown by the following general formula (1):

General formula (1)

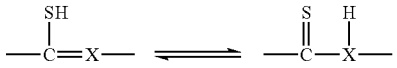

wherein X represents a trivalent atom or atomic group.

The fifth aspect of the invention is to provide a resin composition (S), wherein the thiol compound can tautomerize as shown by the general formula (1) and X in the general formula (1) is a nitrogen atom or a methine group.

The sixth aspect of the invention is to provide a resin composition (S), wherein the thiol compound is an aliphatic hydrocarbon having an SH group on a side chain or at a terminal.

The seventh aspect of the invention is to provide a resin composition (S), wherein the thiol compound is a cyclic hydrocarbon substituted by an SH group or a heterocycle substituted by an SH group.

The eighth aspect of the invention is to provide a resin composition (S), wherein the thiol compound is a cyclic hydrocarbon substituted by an SH group or a heterocycle substituted by an SH group, and the cyclic hydrocarbon substituted by an SH group is a compound represented by the following general formula:

General formula

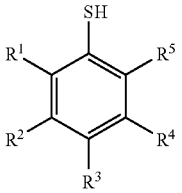

wherein in general formula, $R^1$ through $R^5$ each independently represent a hydrogen atom, an alkyl group, a halogen atom, an alkoxy group, or a mercapto group.

The ninth aspect of the invention is to provide a resin composition (S), wherein the thiol compound is a cyclic hydrocarbon substituted by an SH group or a heterocycle substituted by an SH group, and the heterocycle substituted by an SH group has two nitrogen atoms in the heterocycle and is represented by the following general formula:

General formula

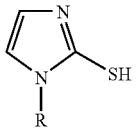

wherein in general formula, R represents a hydrogen atom or an alkyl group.

The tenth aspect of the invention is to provide a resin composition (S), wherein the thiol compound is a cyclic hydrocarbon substituted by an SH group or a heterocycle substituted by an SH group, and the heterocycle substituted by an SH group has three nitrogen atoms in the heterocycle and is represented by at least one of the following general formulae:

General formulae

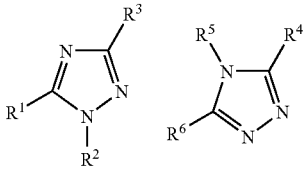

wherein in general formulae, $R^1$ through $R^6$ each independently represent a hydrogen atom, an alkyl group, an aryl group, an amino group, or a mercapto group, at least one of $R^1$ and $R^3$ represents a mercapto group, and at least one of $R^4$ and $R^6$ represents a mercapto group.

The eleventh aspect of the invention is to provide a resin composition (S), wherein the thiol compound is a cyclic hydrocarbon substituted by an SH group or a heterocycle substituted by an SH group, and the heterocycle substituted by an SH group has four nitrogen atoms in the heterocycle and is represented by the following general formula:

General formula

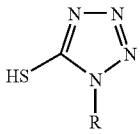

wherein in general formula, R represent an alkyl group or an aryl group, and when R represents an aryl group, R may represent an aryl group that has a substituent selected from the group consisting of a hydroxyl group, a carbamoyl group, and a carboxyl group.

The twelfth aspect of the invention is to provide a resin composition (S), wherein the thiol compound is a cyclic hydrocarbon substituted by an SH group or a heterocycle substituted by an SH group, and the heterocycle substituted by an SH group is a compound represented by the following general formula:

General formula

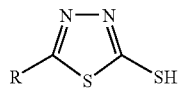

wherein in general formula, R represents an alkyl group, an amino group, an alkylthio group, or a mercapto group.

The thirteenth aspect of the invention is to provide a resin composition (S), wherein the thiol compound is a cyclic hydrocarbon substituted by an SH group or a heterocycle substituted by an SH group, and the heterocycle substituted by an SH group is a compound represented by the following general formula:

General formula

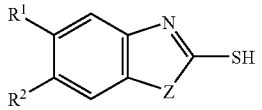

wherein in general formula, $R^1$ and $R^2$ each independently represent a hydrogen atom, an alkyl group, an alkoxy group, a halogen atom, a carbamoyl group, a nitro group, or a sulfonate group, and Z represents —NH—, an oxygen atom, or a sulfur atom.

The fourteenth aspect of the invention is to provide a resin composition (S), wherein the thiol compound is a cyclic hydrocarbon substituted by an SH group or a heterocycle substituted by an SH group, and the heterocycle substituted by an SH group is a compound represented by the following general formula:

General formula

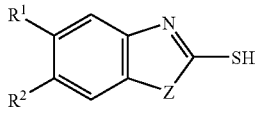

wherein in general formula, $R^1$ and $R^2$ each independently represent a hydrogen atom, an alkyl group, an alkoxy group, a halogen atom, a carbamoyl group, a nitro group, or a sulfonate group, and Z represents an oxygen atom or a sulfur atom.

The fifteenth aspect of the invention is to provide a resin composition (S), wherein the thiol compound is a cyclic hydrocarbon substituted by an SH group or a heterocycle substituted by an SH group, and the heterocycle substituted by an SH group is a compound represented by the following formula:

General formula

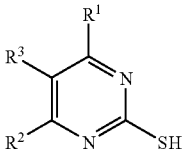

wherein in general formula, $R^1$ through $R^3$ each independently represent a hydrogen atom, an alkyl group, a haloalkyl group, a hydroxyl group, an amino group, a nitroso group, or a mercapto group.

The sixteenth aspect of the invention is to provide a resin composition (S), wherein the thiol compound is a compound obtained by substituting an SH group for a substituent on a cyclic hydrocarbon.

The seventeenth aspect of the invention is to provide a resin composition (S), wherein the thiol compound is contained in an amount of 0.2 to 20% by mass based on a total solids content of the resin composition.

The eighteenth aspect of the invention is to provide a positive-type image recording layer containing a resin composition comprising:

(A) an alkali-soluble resin;

(B) an infrared absorbing agent; and (C) a thiol compound, wherein a solubility of the resin composition in an alkaline aqueous solution is changed by exposure with an infrared laser beam.

The nineteenth aspect of the invention is to provide a positive-type image recording layer containing a resin composition comprising:

(A) an alkali-soluble resin;

(B) an infrared absorbing agent; and (C) a thiol compound, wherein a solubility of the resin composition in an alkaline aqueous solution is changed by exposure with an infrared laser beam, and the thiol compound can tautomerize as shown by the following general formula (1):

General formula (1)

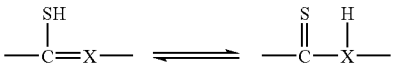

wherein X represents a trivalent atom or atomic group.

The twentieth aspect of the invention is to provide a negative-type image recording layer containing a resin composition comprising:

(A) an alkali-soluble resin;

(B) an infrared absorbing agent; and (C) a thiol compound, wherein a solubility of the resin composition in an alkaline aqueous solution is changed by exposure with an infrared laser beam.

DETAILED DESCRIPTION OF THE INVENTION

A resin composition of the present invention is characterized by that the composition contains: an alkali-soluble resin (A); an infrared absorbing agent (B) absorbing light energy such as infrared light to generate heat; and a thiol compound (C). Description will be given sequentially of components composing a resin composition recited in the invention below.

A resin composition recited in the invention is preferably used as a recording layer of a planographic printing plate precursor and such recording layers are classified into two types one of which is a "positive type" a solubility in an alkali aqueous solution of which is increased by exposure to infrared laser light and the other of which is a "negative type" a solubility in an alkali aqueous solution of which is, to the contrary, decreased by exposure to infrared laser light. Details of the recording layers of both types will be given later.

[Thiol Compound (C)]

While thiol compounds used in the invention have only to be compounds having at least one mercapto group (—SH) in its structure and there is no specific other limitation on the compounds, thiol compounds used in the invention are preferably compounds each having a high molecular weight and a low volatility from the viewpoint of suppression of an odor unique to a mercapto compound. A molecular weight of such a thiol compound is preferably 90 or higher and more preferably 110 or higher. Preferable from the similar viewpoint are a thiol compound having plural mercapto groups in one molecule and an aromatic thiol compound.

In the invention, preferably used is a tautomerizable thiol compound as represented by the following general formula (1). It is inferred that such a thiol compound is dissolved out by infiltration of an alkali aqueous solution into a resin composition when a developing process is operated, and an equilibrium of tautomerism in forms of the dissolved thiol compound is shifted to the SH side ((i) side), there arises an effect of further accelerating increase in an solubility of a resin composition.

General formula (1)

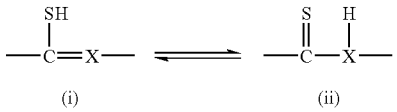

In the general formula (1), X indicates a trivalent atom or atomic group and among them, preferably indicates a nitrogen atom or a methine group (CH), wherein a nitrogen atom is especially preferable from the viewpoint of tautomerism caused with ease.

As thiol compounds recited in the invention, there are organic compounds each having an SH group and generally used is a hydrocarbon type compound having an SH group. While it is only required to have at least one SH group in a molecule, needless to say that a hydrocarbon may have plural SH groups in a molecule.

As chain compounds, there are aliphatic hydrocarbons each having SH on a side chain or at a terminal of a molecule. The hydrocarbon compounds may be linear or branched and may have a substitutent such as a hydroxyl group, a halogen atom, amino group or the like.

A methylene group in a hydrocarbon compound may be substituted with a divalent organic group such as ether, thioether, ester, amide, urea, thiourea or the like.

As such compounds, there is a compound such as linear hydrocarbons each having carbon atoms of 2 to 18 such as ethane, butane, hexane, nonane, decane, dodecane, octadecane and the like which are substituted by an SH group or SH groups at one terminal or both terminals, a hydrocarbon compound having carbon atoms of 2 to 18 in which an SH group is substituted for a substituent on a carbon in its chain and a compound obtained by replacing a methine group in the above-compound with an ether bond or an ester bond.

As cyclic compounds, there is an alicyclic hydrocarbon, an aromatic hydrocarbon, a condensed polycyclic hydrocarbon and furthermore, a heterocyclic compound and the like. There may be cited a compound having two or more independent cyclic structures in a molecule. In cyclic hydrocarbon compounds, there may be cited compounds having, in addition to an SH group, a substituent such as an alkyl group, a halogen atom, a hydroxyl group or the like.

As such compounds, a compound obtained by substituting a substituent on a cyclic hydrocarbon such as cyclohexane, benzene, naphthalene, with an SH group, a compound obtained by replacing a substitutent such as alkyl group on a cyclic hydrocarbon with an SH group, and a compound obtained by substituting a substituent on a heterocycle with an SH group, can be cited.

As described above, a molecular weight of a thiol compound is preferably relatively large. However, there is a tendency in a linear hydrocarbon compound that a solubility decreases with increase in a molecular weight; therefore, a compound having a branched chain or a cyclic structure is preferable from the viewpoint of preparation of a coating liquid.

Among them, from the viewpoint that a compound having tautomerism is preferable as described above, an aromatic thiol compound having a conjugated double bond in a molecule, a heterocycle containing thiol compound and the like can be cited, and especially preferable is an aromatic thiol compound.

Furthermore, preferably used as a thiol compound recited in the invention is also so-called thione compounds each having —C═S, which is usually described in the form having an SH group (compounds such as ones each having a structure represented by the general formula (1) (ii)) and as such compounds, a thiourea compound, a thioamide compound and the like can be cited.

There are shown thiol compounds preferably used in the invention in a specific manner, the invention is not limited to those.

| $CH_3(CH_2)_nCH_2SH$ | | |
|---|---|---|
| n = | 4 | T-1 |
| | 5 | T-2 |
| | 6 | T-3 |
| | 7 | T-4 |
| | 8 | T-5 |
| | 10 | T-6 |
| | 14 | T-7 |
| | 16 | T-8 |

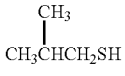

T-9

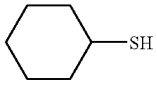

T-10

$HSCH_2(CH_2)_nCH_2SH$

| | | |
|---|---|---|
| n = | 0 | T-11 |
| | 1 | T-12 |
| | 2 | T-13 |
| | 3 | T-14 |
| | 4 | T-15 |
| | 6 | T-16 |
| | 7 | T-17 |

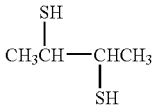

T-18

$HSCH_2CH_2OH$

T-19

-continued

| | |
|---|---|
| $CH_3CH(OH)CH_2SH$ T-20 | $HSCH_2CH_2CH_2OH$ T-21 |
| $HSCH_2CH(OH)CH_2OH$ T-22 | $HSCH_2CH(SH)CH_2OH$ T-23 |
| $HSCH_2CH(OH)CH(OH)CH_2SH$ T-24 | $HSCH_2CH_2OCH_2CH_2SH$ T-25 |
| $(H_3C)_2NCH_2CH_2SH$ T-26 | |

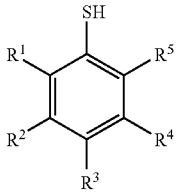

| | $R^1$ | $R^2$ | $R^3$ | $R^4$ | $R^5$ |
|---|---|---|---|---|---|
| T-27 | H | H | H | H | H |
| T-28 | $CH_3$ | H | H | H | H |
| T-29 | $C_2H_5$ | H | H | H | H |
| T-30 | $CH(CH_3)_2$ | H | H | H | H |
| T-31 | Cl | H | H | H | H |
| T-32 | Br | H | H | H | H |
| T-33 | $OCH_3$ | H | H | H | H |
| T-34 | H | $CH_3$ | H | H | H |
| T-35 | H | Cl | H | H | H |
| T-36 | H | Br | H | H | H |
| T-37 | H | $OCH_3$ | H | H | H |
| T-38 | H | H | $CH_3$ | H | H |
| T-39 | H | H | F | H | H |
| T-40 | H | H | Cl | H | H |
| T-41 | H | H | $OCH_3$ | H | H |
| T-42 | H | H | OH | H | H |
| T-43 | $CH_3$ | H | H | H | $CH_3$ |
| T-44 | Cl | H | H | H | Cl |
| T-45 | H | $CH_3$ | H | $CH_3$ | H |
| T-46 | H | $CH_3$ | $CH_3$ | H | H |
| T-47 | $CH_3$ | H | $CH_3$ | H | H |
| T-48 | $CH_3$ | H | H | $CH_3$ | H |
| T-49 | Cl | H | H | Cl | H |
| T-50 | H | Cl | Cl | H | H |
| T-51 | SH | H | H | H | H |
| T-52 | H | SH | H | H | H |
| T-53 | H | H | SH | H | H |
| T-54 | SH | H | $CH_3$ | H | H |
| T-55 | H | SH | Cl | H | H |
| T-56 | F | F | H | F | F |
| T-57 | F | F | F | F | F |
| T-58 | $OC_{12}H_{25}$ | H | H | $CH_3$ | H |

T-59

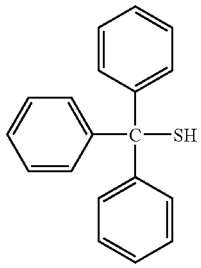

T-60

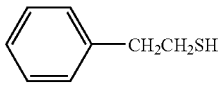

T-61

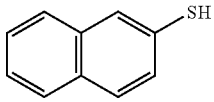

T-62

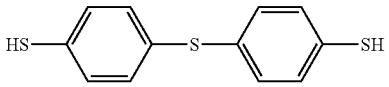

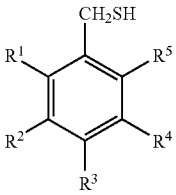

| | $R^1$ | $R^2$ | $R^3$ | $R^4$ | $R^5$ |
|---|---|---|---|---|---|
| T-63 | H | H | H | H | H |
| T-64 | $CH_3$ | H | $CH_3$ | H | $CH_3$ |
| T-65 | H | H | Cl | H | H |
| T-66 | H | H | $OCH_3$ | H | H |
| T-67 | $CH_2SH$ | H | H | H | H |
| T-68 | H | $CH_2SH$ | H | H | H |
| T-69 | H | H | $CH_2SH$ | H | H |
| T-70 | $CH_2SH$ | H | $CH_3$ | $CH_3$ | H |
| T-71 | $CH_3$ | $CH_2SH$ | $CH_3$ | H | $CH_3$ |

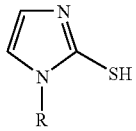

| | R |
|---|---|
| T-72 | H |
| T-73 | $CH_3$ |

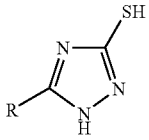
| | R |
|---|---|
| T-74 | H |
| T-75 | $CH_3$ |
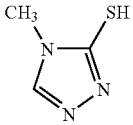
T-76
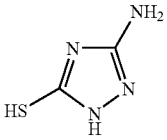
T-77
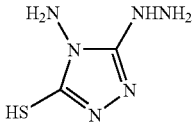
T-78
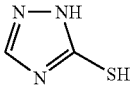
T-79
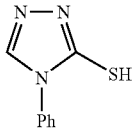
T-80
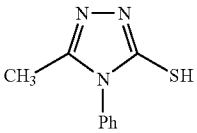
T-81
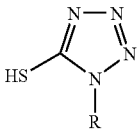
| | R |
|---|---|
| T-82 | $CH_3$ |
| T-83 | 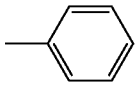 |
| T-84 | 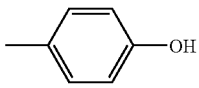 |
| T-85 | 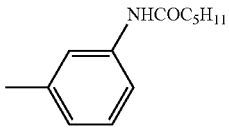 |
| T-86 | 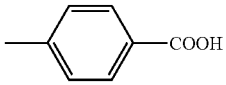 |
T-87
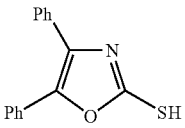
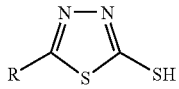
| | R |
|---|---|
| T-88 | $CH_3$ |
| T-89 | $NH_2$ |
| T-90 | SH |
| T-91 | $SCH_3$ |
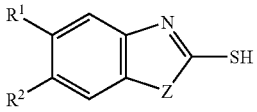
| | Z | $R^1$ | $R^2$ |
|---|---|---|---|
| T-92 | NH | H | H |
| T-93 | NH | $CH_3$ | H |
| T-94 | NH | $OCH_3$ | H |
| T-95 | NH | $NO_2$ | H |
| T-96 | NH | $SO_3Na$ | H |
| T-97 | O | H | H |
| T-98 | S | H | H |
| T-99 | S | Cl | H |
| T-100 | S | H | $OC_2H_5$ |
| T-101 | NH | H | $NHCOCHC_4H_9$ \| $C_2H_5$ |
T-102
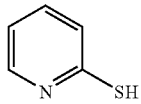
T-103
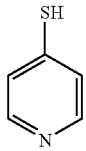
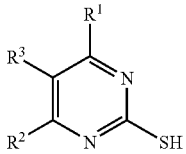
| | $R^1$ | $R^2$ | $R^3$ |
|---|---|---|---|
| T-104 | H | H | H |
| T-105 | $CH_3$ | H | H |
| T-106 | $CF_3$ | H | H |
| T-107 | $CH_3$ | $CH_3$ | H |
| T-108 | OH | H | H |
| T-109 | OH | $CH_3$ | H |
| T-110 | OH | $CH_2CH_2CH_3$ | H |

-continued

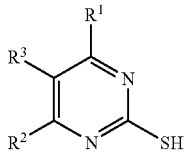

| | $R^1$ | $R^2$ | $R^3$ |
|---|---|---|---|
| T-111 | OH | OH | H |
| T-112 | $NH_2$ | $NH_2$ | H |
| T-113 | $NH_2$ | SH | $NH_2$ |
| T-114 | $NH_2$ | OH | H |
| T-115 | $NH_2$ | OH | $NH_2$ |
| T-116 | OH | $NH_2$ | NO |

T-117

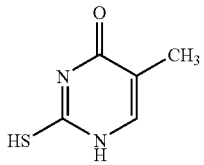

T-118

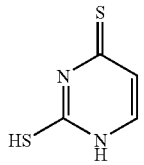

T-119

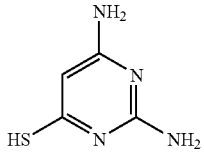

T-120

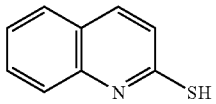

T-121

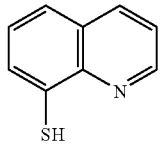

T-122

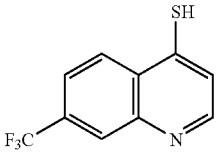

A thiol compound recited in the invention is preferably added into a resin composition in an amount of 0.2 to 20% by mass and more preferably of 0.5 to 10% by mass relative to the entire solids content of the resin composition. If an addition amount is excessively small, a fault arises that an excellent development latitude and an excellent image contrast, which is the effects of the invention, become hard to attain, while if excessively large, film characteristics of a coated layer tend to be deterionated.

[Alkali-soluble Resin (A)]

Examples of alkali-soluble resins (A) used in a resin composition recited in the invention include homopolymers each containing an acidic group in a main chain and/or a side chain in a polymer; copolymers thereof; and mixtures thereof.

Among them, those containing acidic groups listed in the following (1) to (6) in a main chain and/or a side chain in a polymer are preferable in view of development resistance and a solubility in an alkali aqueous solution.

(1) phenol group (—Ar—OH)

(2) sulfoneamide group ($—SO_2NH—R$)

(3) substituted sulfone amide based acidic group (hereinafter referred to as a "active imide group") [$—SO_2NHCOR$, $—SO_2NHSO_2R$ and $—CONHSO_2R$]

(4) carboxyl group ($—CO_2H$)

(5) sulfonic group ($—SO_3H$)

(6) phosphoric group ($—OPO_3H_2$)

Of (1) to (6), Ar indicates a divalent aryl connecting group that may have a substituent and R indicates a hydrocarbon group that may have a substituent.

Among alkali-soluble resins having an acidic group selected from the group consisting (1) to (6) described above, preferable are alkali-soluble resins having (1) a phenol group, (2) a sulfoneamide group, or (3) an active imide group and especially preferable are an alkali-soluble resin having (1) a phenol group or (2) a sulfoneamide group since it is excellent in view of a solubility in an alkaline developing solution, development lattitude and achievement of a sufficient film strength.

As alkali-soluble resins each having an acidic group selected from the group consisting of (1) to (6), there are exemplified the following resins:

(1) As alkali-soluble resins each having a phenol group, there can also be exemplified: novolak resins such as a condensation polymer of phenol and formaldehyde; a condensation polymer of m-cresol and formaldehyde; a condensation polymer of p-cresol and formaldehyde; a condensation polymer of a m-/p-mixed cresol and formaldehyde; a condensation polymer of phenol, cresol (any of m-, p- or m-/p- mixed cresol may be adopted), and formaldehyde; and a condensation polymer of pyrogallol and acetone. Alternatively, there can also be used a copolymer obtained by copolymerization of compounds each having a phenol group on a side chain.

As compounds each having a phenol group, acrylamide, methacrylamide, an acrylate ester, a methacrylate ester, hydroxystyrene or the like, each having a phenol group, can be cited.

As alkali-soluble resins (2), each having a sulfoneamide group, there are exemplified polymers each mainly composed of minimum structural units derived from a compound having a sulfoneamide group. As compounds as described above, compounds each having at least one sulfoneamide group in which at least one hydrogen atom is bonded to a nitrogen atom, and at least one polymerizable unsaturated group, can be cited. Among them, preferable are low molecular weight compounds each having one of an acryloyl group, an aryl group, and a vinyloxy group, and one of a substituted or mono-substituted aminosulfonyl group and a substituted sulfonylimino group. And, for example, compounds represented by the following general formulae (i) to (v) can be cited:

(i)

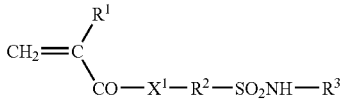

(ii)

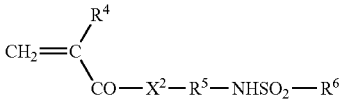

(iii)

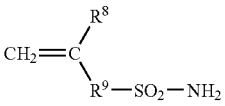

(iv)

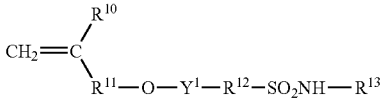

(v)

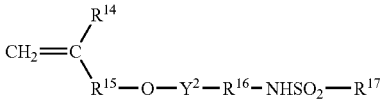

wherein, in the formulae, $X^1$ and $X^2$ each independently represent —O— or —$NR^7$; $R^1$ and $R^4$ each independently represent a hydrogen atom or —$CH_3$; $R^2$, $R^5$, $R^9$, $R^{12}$ and $R^{16}$ each independently represent an alkylene group, a cycloalkylene group, an arylene group or an aralkylene group, having 1 to 12 carbon atoms which can be substituted; $R^3$, $R^7$ and $R^{13}$ each independently represent a hydrogen atom, or an alkyl group, a cycloalkyl group, an aryl group or an aralkyl group, having 1 to 12 carbon atoms which can be substituted; $R^6$ and $R^{17}$ each independently represent an alkyl group, a cycloalkyl group, an aryl group or an aralkyl group, having 1 to 12 carbon atoms which can be substituted; $R^8$, $R^{10}$ and $R^{14}$ each independently represent a hydrogen atom or —$CH_3$; $R^{11}$ and $R^{15}$ each independently represent a single-bond, or one of an alkylene group, a cycloalkylene group, an arylene group, and an aralkylene group, having 1 to 12 carbon atoms which can have a substituent; and $Y^1$ and $Y^2$ each independently represent a single bond or CO.

Among compounds represented by the general formulae (i) to (v), especially preferably used in a resin composition recited in the invention are m-aminosulfonylphenyl methacrylate, N-(p-aminosulfonylphenyl)methacrylamide, N-(p-aminosulfonylphenyl)acrylamide and the like.

As alkali-soluble resins (3), each having an active imide group, there is exemplified polymers each mainly composed of minimum structural units derived from a compound having an active imide group. As compounds as described above, there are compounds each having at least one active imide group represented by the following structural formula and at least one polymerizable unsaturated group in a molecule.

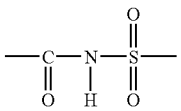

Specifically, preferably used are N-(p-toluenesulfonyl) methacrylamide, N-(p-toluenesulfonyl)acrylamide and the like.

As alkali-soluble resins (4), each having a carboxyl group, there is exemplified polymers each mainly composed of minimum structural units derived from a compound having at least one carboxyl group and at least one polymerizable unsaturated group. As alkali-soluble resins (5), each having a sulfonic group, there is exemplified polymers each mainly composed of minimum structural units derived from a compound having at least one sulfonic group and at least one polymerizable unsaturated group. As alkali-soluble resins (6), each having a phosphoric group, there is exemplified polymers each mainly composed of minimum structural units derived from a compound having at least one phosphoric group and at least one polymerizable unsaturated group.

A minimum structural unit, having an acidic group selected from the group consisting of (1) to (6), and constructing an alkali-soluble resin used in a resin composition recited in the invention is not particularly required to be of a single kind only. There can also be used copolymers obtained by copolymerization of two or more kinds of minimum structural units each having the same acidic group, or two or more kinds of minimum structural units each having an acidic group different from that of the other.

A copolymer described above is preferably contains an acidic group selected from the group consisting of (1) to (6) in an amount of 10% by mol or higher and more preferably 20% by mol or higher. If the amount is less than 10% by mol, there appears a tendency that a development latitude cannot be sufficiently improved.

In the invention, in the case where compounds are copolymerized and an alkali-soluble resin is used in the form of a copolymer, there can also be used other compounds containing none of the acidic groups listed as (1) to (6) as compounds to be copolymerized into the resin. As the other compounds containing none of the acidic groups listed as (1) to (6), there are exemplified the following compounds (m1) to (m12), but no specific limitation is imposed to a particular one, which are:

(m1) acrylate esters and methacrylate esters each having an aliphatic hydroxyl group such as 2-hydroxyethylacrylate, 2-hydroxyethylmetacrylate or the like;

(m2) alkylacrylates, such as methyl acrylate, ethyl acrylate, propyl acrylate, butyl acrylate, amyl acrylate, hexyl acrylate, octyl acrylate, benzyl acrylate, 2-chloroethyl acrylate, glycidyl acrylate and the like;

(m3) alkyl methacrylates, such as methyl methacrylate, ethyl methacrylate, propyl methacrylate, butyl methacrylate, amyl methacrylate, hexyl methacrylate, cyclohexyl methacrylate, benzyl methacrylate, 2-chloroethyl methacrylate, glycidyl methacrylate and the like;

(m4) acrylamides or methacrylamides, such as acrylamide, methacrylamide, N-methylolacrylamide, N-ethylacrylamide, N-hexylmethacrylamide, N-cyclohexylacrylamide, N-hydroxyethylacrylamide, N-phenylacrylamide, N-nitrophenylacrylamide, N-ethyl-N-phenylacrylamide and the like;

(m5) vinylethers, such as ethyl vinyl ether, 2-cloroethyl vinyl ether, hydroxyethyl vinyl ether, propyl vinyl ether, butyl vinyl ether, octyl vinyl ether, phenyl vinyl ether and the like;

(m6) vinyl esters, such as vinyl acetate, vinyl chloroacetate, vinyl butylate, vinyl benzoate and the like;

(m7) styrenes, such as styrene, α-methyl styrene, methyl styrene, chloromethyl styrene and the like;

(m8) vinyl ketones, such as methyl vinyl ketone, ethyl vinyl ketone, propyl vinyl ketone, phenyl vinyl ketone and the like;

(m9) olefins, such as ethylene, propylene, isobutylene, butadiene, isoprene and the like;

(m10) N-vinylpyrrolidone, acrylonitril, methacrylnitril and the like;

(m11) unsaturated imide, such as maleimide, N-acryloylacrylamide, N-acetylmethacrylamide, N-propionylmethachrylamide, N-(p-chlorobenzoil) methacrylamide and the like; and (m12) unsaturated carboxylic acids, such as acrylic acid, methacrylic acid, maleic anhydride, itaconic acid and the like.

As alkali-soluble resins, the presence of a phenolic hydroxyl group in the resin is preferable in that it is excellent in image forming property when exposed with infrared laser light and there are preferably exemplified: novolak resins such as phenol-formaldehyde resin, m-cresol-formaldehyde resin, p-cresol-formaldehyde resin, m-/p-mixed cresol-formaldehyde resin, phenol-cresol (any of m-, p- or m-/p-mixed cresol may be adopted) mixed formaldehyde resin and a pyrogallol-acetone resin.

As alkali-soluble resins each having a phenolic hydroxyl group, there are further exemplified as described in U.S. Pat. No. 4,123,279: condensation polymers of formaldehyde and phenol having an alkyl group having 3 to 8 carbon atoms as a substituent, such as t-butylphenol-formaldehyde resin, octylphenol-formaldehyde resin and the like.

An alkali-soluble resin preferably has a weight average molecular weight of 500 or higher and more preferably has a weight average molecular weight of 1,000 to 700,000 in view of an image forming property. A number average molecular weight thereof is preferably 500 or higher and more preferably is from 750 to 650,000. A degree of dispersion (weight average molecular weight/number average molecular weight) is preferably in the range of from 1.1 to 1.0.

Furthermore, the alkali-soluble resins may be used not only alone but also in combination of two or more kinds of them. If plural of resins are used in combination, additionally, a condensation polymer of t-butylphenol and formaldehyde recited in U.S. Pat. No. 4,123,279, a condensation polymer of formaldehyde and a phenol having an alkyl group having 3 to 8 carbon atoms as a substituent, such as a condensation polymer of octylphenol and formaldehyde, an alkali-soluble resin having a phenol structure having an electron attractive group on the aromatic ring, which is described in JP-A No. 2000-24197, previously filed, and invented by the inventors, or the like may be used simultaneously.

The total amount of an alkali-soluble resin recited in the invention is preferably from 30 to 98% by mass, on the basis of the entire solids in a resin composition, and more preferably of 40 to 95% by mass. If the amount is less than 30% by mass, a tendency arises that durability is degraded, while if the amount is more than 98% by mass, a tendency arises that a sensitivity is lowered and an image forming property is degraded. Thus, both cases are not preferable.

[Infrared Absorbing Agent (B)]

As infrared absorbing agents used in the invention, any material can be used as far as it absorbs light energy irradiation to generate heat without imposing any specific limitation on a range of absorption wavelengths, but preferably used are an infrared absorbing dye or pigment having a maximum absorption wavelenght in the range of 760 nm to 1200 nm, from the viewpoint of adaptability to a high power laser that can be acquired with ease.

As dyes, there can be used dyes on the market and public known dyes such as those described in literatures such as "Dye Manual," (edited by The Society of Synthetic Organic Chemistry, Japan, published in 1970) and the like. Specifically there are exemplified dyes such as azo dye, metal complex azo dye, pyrazolone azo dye, naphtoquinone dye, anthraquinone dye, phthalocyanine dye, carbonium dye, quinoneimine dye, methine dye, cyanine dye, squarylium dye, pyrylium salt, metal thiolate complex, oxonol dye, diimmonium dye, aminium dye, croconium dye and the like.

As preferred dyes, there are exemplified the following dyes: cyanine dye described in JP-A Nos. 58-125246, 59-84356, 59-202829, 60-78787 and others; methine dye described in JP-A Nos. 58-173696, 58-181690, 58-194595 and others; naphthoquinone dye described in JP-A Nos. 58-112793, 58-224793, 59-48187, 59-73996, 60-52940, 60-63744 and others; squarylium dye described in JP-A No. 58-112792 and others; and cyanine dye described in British Patent No. 434,875 and others.

Furthermore, there are also preferably used a near-infrared absorbing sensitizer described in U.S. Pat. No. 5,156,938 and moreover, there are also preferably used the following compounds: substituted arylbenzo(thio)pyrylium salt described in U.S. Pat. No. 3,881,924; trimethinethiapyrylium salt described in JP-A No. 57-142645 (U.S. Pat. No. 4,327,169); pyrylium type compounds described in JP-A Nos. 58-181051, 58-220143, 59-41363, 59-84248, 59-84249, 59-146063 and 59-146061; cyanine dye described in JP-A No. 59-216146; pentamethine thiopyrylium salt and the like described in U.S. Pat. No. 4,283,475; and a pyrylium compound disclosed in Japanese Patent Application Publication (JP-B) Nos. 5-13514 and 5-19702.

Furthermore, as another example of preferable dye, there are near-infrared absorbing dyes described as formulae (I) and (II) in U.S. Pat. No. 4,756,993.

Especially preferable among the dyes are cyanine dye, phthalocyanine dye, oxonol dye, squarylium dye, pyrylium salt, thiopyrylium dye and nickel thiolate complex. Dyes represented by the following general formulae (a) to (e) are preferable because of their excellent photothermal conversion efficiency and especially a cyanine dye represented by the following general formula (a) is the most preferable since the dye, when used in a resin composition recited in the invention, gives a high interaction with an alkali-soluble resin and is excellent in stability and economy.

General formula (a)

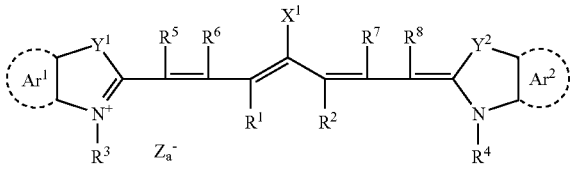

In the general formula (a), $X^1$ indicates a hydrogen atom, a halogen atom, —$NPh_2$, $X^2$—$L^1$ or a group shown below, wherein $X^2$ indicates an oxygen atom or a sulfur atom, $L^1$ indicates a hydrocarbon group having 1 to 12 carbon atoms, an aromatic ring having a hetero atom, or a hydrocarbon group including a hetero atom and having 1 to 12 carbon atoms, wherein a hetero atom indicates an atom selected from the group consisting of N, S, O, a halogen atom and Se.

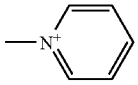

And $R^1$ and $R^2$ each independently represent a hydrocarbon group having 1 to 12 carbon atoms, each are preferably a hydrocarbon group having two or more carbon atoms and especially preferably combine with each other to form a 5 membered ring or a 6 membered ring from the viewpoint of shelf-stability of a coating solution for an image recording layer.

$Ar^1$ and $Ar^2$ may be identical to or different from each other, each representing an aromatic hydrocarbon group that may have a substituent. As preferable aromatic hydrocarbon groups, a benzene ring and a naphthalene ring can be cited, and as preferable substituents, there are a hydrocarbon group having 12 or less carbon atoms, a halogen atom, an alkoxy group having 12 or less carbon atoms; $Y^1$ and $Y^2$ may be identical to or different from each other, each representing a sulfur atom or a dialkylmethylene group having 12 or less carbon atoms; $R^3$ and $R^4$ may be identical to or different from each other, each representing a hydrocarbon group having 20 or less carbon atoms that may have a substituent. As preferable substituents, an alkoxy group having 12 or less carbon atoms, a carboxyl group and a sulfo group can be cited. $R^5$, $R^6$, $R^7$ and $R^8$ may be identical to or different from each other, each representing a hydrogen atom or a hydrocarbon group having 12 or less carbon atoms, wherein a hydrogen atom is preferable because of availability of a raw material; and $Za^-$ represents a counter anion providing that in the case where any one of $R^1$ to $R^8$ is substituted by a sulfo group therein, $Za^-$ is not necessary, wherein a $Za^-$ is preferably a halogen ion, a perchlorate ion, a tetrafluoroborate ion, a hexafluorophosphate ion or a sulfonate ion and especially preferably a perchlorate ion, a hexafluorophosphate ion and an arylsulfonate ion from the viewpoint of shelf-stability of a coating solution for an image recording layer.

As specific examples of cyanine dye represented by the general formula (a), which can be preferably used in the invention, there are, in addition to the compounds exemplified below, those described in paragraphs [0017] to [0019] of JP-A No. 2001-133969; paragraphs [0012] to [0038] of JP-A No. 2002-40638; and paragraphs [0012] to [0023] of JP-A No. 2002-23360.

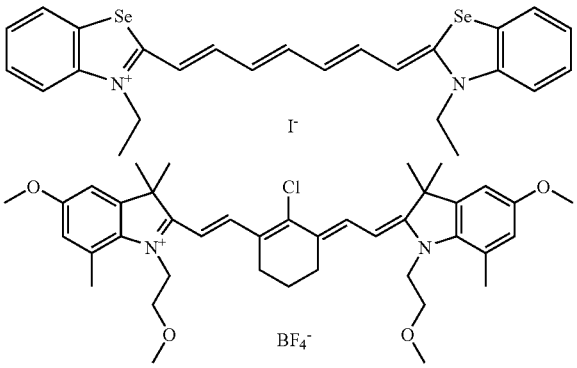

-continued

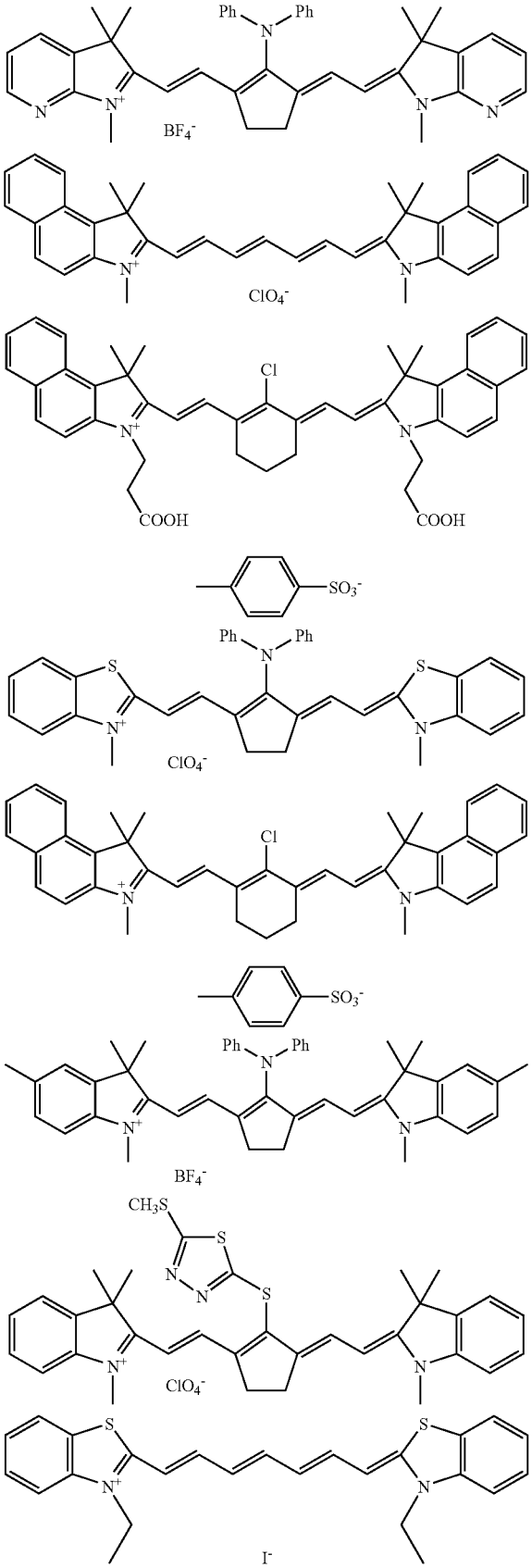

-continued

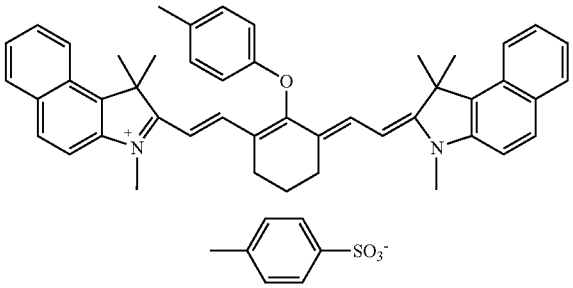

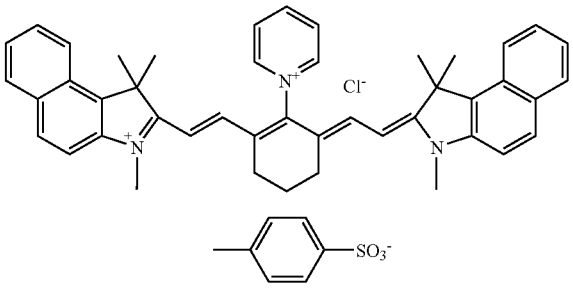

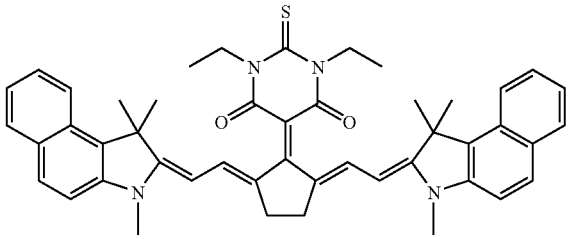

General formula (b)

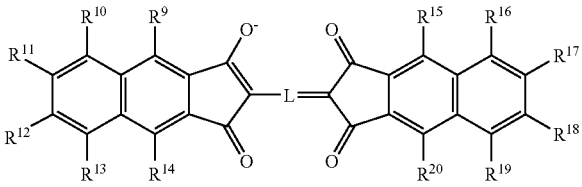

$Zb^+$

In the general formula (b), L represents a methine chain having 7 or more conjugated carbon atoms, wherein the methine chain may have a substituent or substituents bonded to each other to form a cyclic structure; $Zb^+$ represents a counter cation. As preferable cations, there are exemplified ammonium, iodonium, sulfonium, phosphonium, pyridium and alkali metal cations ($Ni^+$, $K^+$ and $Li^+$); $R^9$ to $R^{14}$ and $R^{15}$ to $R^{20}$ each represent a hydrogen atom or a substituent selected from the group consisting of a halogen atom, a cyano group, an alkyl group, an aryl group, an alkenyl group, an alkynyl group, a carbonyl group, a thio group, a sulfonyl group, a sulfinyl group, an oxy group and an amino group, or a group obtained by combining two or three of the groups described above, which may form a cyclic structure, wherein in the general formula (b), preferably, L represents a methine chain having 7 conjugated carbon atoms and $R^9$ to $R^{14}$ and $R^{15}$ to $R^{20}$ each represent a hydrogen atom, from the viewpoint of easy availability and an effect.

As specific examples of dyes represented by the general formula (b) that can be preferably used in the invention, there are exemplified the following compounds:

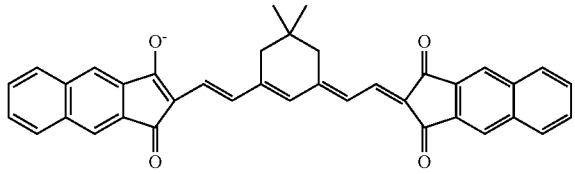

$n\text{-}Bu_4N^+$

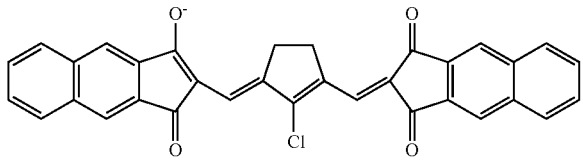

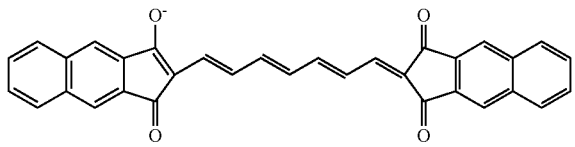

$Me_4N^+$

General formula (c)

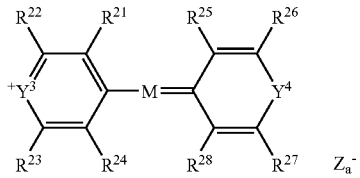

In the general formula (c), $Y^3$ and $Y^4$ each represent an oxygen atom, a sulfur atom, a selenium atom or a tellurium atom; M represents a methine chain having 5 or more conjugated carbon atoms; $R^{12}$ to $R^{24}$ and $R^{25}$ to $R^{28}$ may be identical to or different from each other, each representing a hydrogen atom, a halogen atom, a cyano group, an alkyl group, an aryl group, an alkenyl group, an alkynyl group, a carbonyl group, a thio group, a sulfonyl group, a sulfinyl group, an oxy group or an amino group; and $Za^-$ represents a counter anion and has the same meaning as the $Za^-$ in the general formula (a).

As specific examples of dyes represented by the general formula (c), which can be preferably used in the invention, there are exemplified the following compounds shown below:

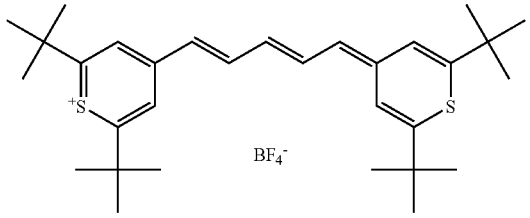

-continued

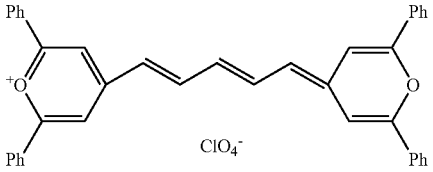

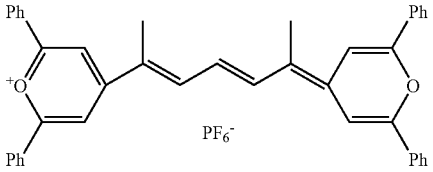

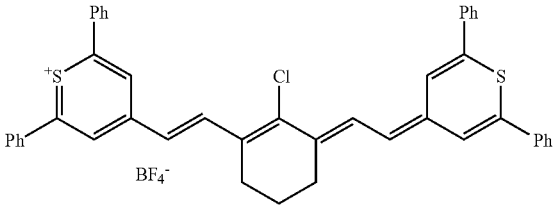

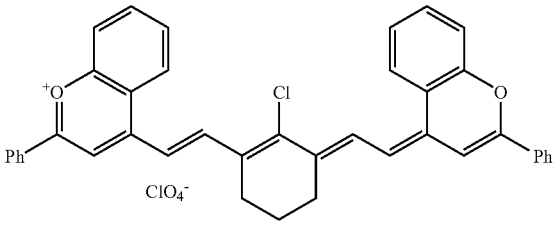

General formula (d)

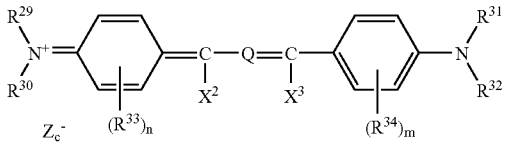

In the general formula (d), $R^{29}$ to $R^{31}$ each independently represent a hydrogen atom, an alkyl group or an aryl group; $R^{33}$ and $R^{34}$ each independently represent an alkyl group, a substituted oxy group or a halogen atom; n and m each independently represent an integer of 0 to 4; $R^{29}$ and $R^{30}$ may be bonded to each other to form a ring and $R^{31}$ and $R^{32}$ may be bonded to each other to form a ring; $R^{29}$ and/or $R^{30}$ may be bonded to $R^{33}$ to form a ring and $R^{31}$ and/or $R^{32}$ may be bonded to $R^{34}$ to form a ring; in the case where there exist a plural $R^{33}$s or a plural $R^{34}$s, $R^{33}$s may be bonded to each other to form a ring and $R^{34}$s may be bonded to each other to form a ring; $X^2$ and $X^3$ each independently represent a hydrogen atom, an alkyl group or an aryl group; at least one of $X^2$ and $X^3$ represents a hydrogen atom or an alkyl group; Q represents a trimethine group or a pentamethine group that may have a substituent, wherein the trimethine group or the pentamethine group may form a cyclic structure together with a divalent organic group; and $Zc^-$ represents a counter anion and has the same meaning as the $Za^-$ in the general formula (a).

As specific examples of dyes represented by the general formula (d) that can be preferably used in the invention, there are exemplified the following compounds shown below:

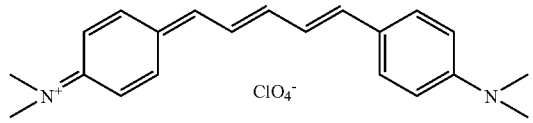

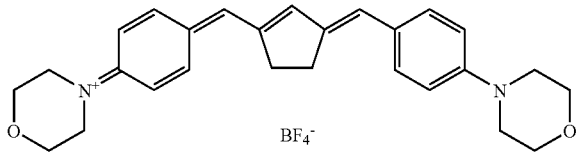

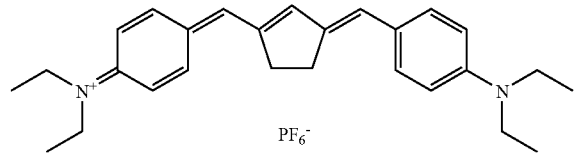

General formula (e)

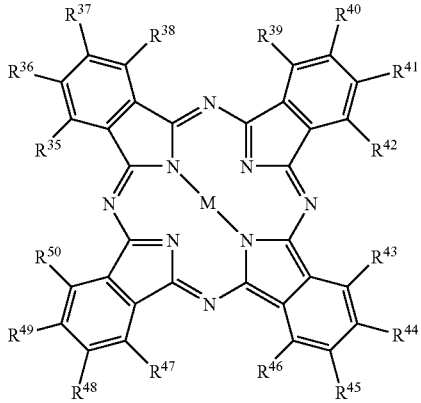

In the general formula (e), $R^{35}$ to $R^{50}$ each independently represent a hydrogen atom, a halogen atom, a cyano group, an alkyl group, an aryl group, an alkenyl group, an alkynyl group, an hydroxyl group, a carbonyl group, a thio group, a sulfonyl group, a sulfinyl group, an oxy group, an amino group, an onium salt structure, wherein each of the groups may have a substituent; M represents two hydrogen atoms, a metal atom, a halometal group, an oxymetal group, wherein as metal atoms included in M, there are exemplified atoms of the groups IA, IIA, IIIB and IVB in the periodic table, transition metals of the first, second and third periods and elements in lanthanoide series, among which preferable are copper, magnesium, iron, zinc, cobalt, aluminum, titanium and vanadium.

As specific examples of dyes represented by the general formula (e) preferably used in the invention, there are exemplified the following compounds shown below:

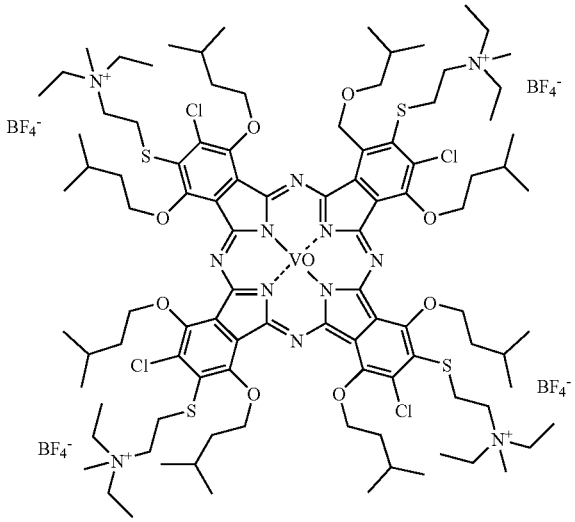

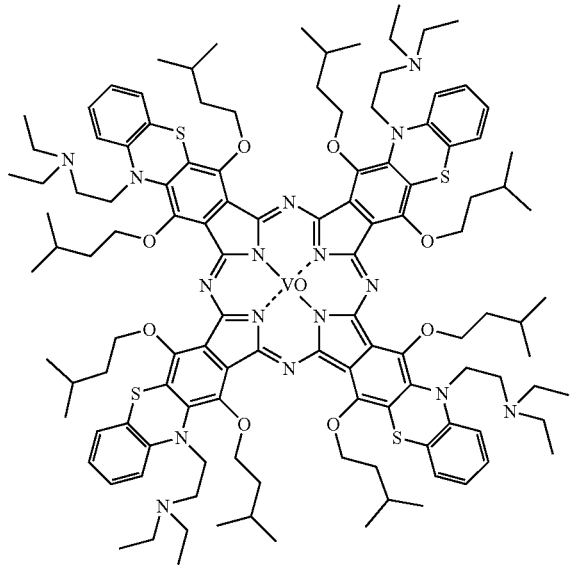

As pigments used as an infrared absorbing agent in the invention, there are pigments described in pigments and color indexes (C.I.) handbook sold on the market, "Saishin Ganryo Binran" (Current Pigment Manual) edited by Nippon Pigment Technology Association, published in 1977, "Saishin Ganryo Ouyou Gijutsu" (Current Pigment Application Technology) published in 1986 by CMC Publishing Co., Ltd. and "Insatsu Inki Gijutsu" (Printing Ink Technology) published in 1984 by CMC Publishing Co., Ltd.

As kinds of pigments, a black pigment, a yellow pigment, an orange pigment, a brown pigment, a red pigment, a purple pigment, a blue pigment, a green pigment, a fluorescent pigment and a metallic powder pigment, and in addition, a polymer coupler dye can be cited. Specifically, there can be used insoluble azo pigment, azo lake pigment, condensed azo pigment, chelate azo pigment, phthalocyanine pigment, anthraquinone pigment, perylene and perynone pigment, thio indigo pigment, quinacridone pigment, dioxazine pigment, isoindolinone pigment, quinophthalone pigment, lake pigment, azine pigment, nitroso pigment, nitro pigment, a natural pigment, a fluorescent pigment, an inorganic pigment, carbon black and others. Preferable among the pigments is carbon black.

The pigments may be used with or without applying a surface treatment. As surface treatments, it is contemplated a method of performing surface coating with a resin or a wax and a method of attaching a surfactant, a method of bonding a reactive material (for example, a silane coupling agent, an epoxy compound, a polyisocyanate or the like) to a pigment surface. These surface treatment methods are described in books: "Kinzokusekkennno Seishitsuto Ouyou" (Properties of Metallic Soap and Its Application) published by Saiwai Shobo, "Insatsu Inki Gijutsu" (Printing Ink Technology) published by CMC Publishing Co., Ltd. in 1984 and "Saishin Ganryou Ouyou Gijutsu" (Current Pigment Application Technology) published in 1986 by CMC Publishing Co., Ltd.

A particle diameter of pigment is preferably in the range of 0.01 μm to 10 μm, more preferably in the range of 0.05 μm to 1 μm and especially preferably in the range of 0.1 μm to 1 μm. Particle diameter of pigment less than 0.01 μm is not preferable in view of stability of dispersed particles in a coating solution for an image recording layer, while particle diameter of pigment more then 10 μm is not preferable in view of uniformity of the image recording layer.

As methods for dispersing pigments, there can be used known dispersing techniques applied in production of an ink or a toner. As dispersing machines, a supersonic dispersing apparatus, a sand mill, an atriter, a pearl mill, a super mill, a ball mill, an impeller, a disperser, a KD mill, a colloid mill, Dynatron, a triple roll mill, a press kneader and the like. Details thereof are described "Saishin Ganryou Ouyou Gijutsu" (Current Pigment Application Technology) published by CMC Publishing Co., Ltd. in 1986.

A pigment or a dye can be added to a resin composition in an amount of 0.01 to 50% by mass and preferably of 0.1 to 10% by mass relative to total solids content of the resin composition, wherein a dye is especially preferably added in an amount of 0.5 to 10% by mass, while a pigment is especially preferably added in an amount of 0.1 to 10% by mass. If an addition amount of a pigment or a dye is less than 0.01% by mass, sensitivity tends to decrease, while if it exceeds 50% by mass, an adverse influence on uniformity or film strength of resin composition may occur with increase in additive amount.

A resin composition recited in the invention, as described above, is preferably used in a recording layer of a planographic printing plate precursor. Such recording layers are classified into a "positive type" that increases a solubility in an alkali aqueous solution under exposure to infrared laser light and a "negative type" that decreases a solubility in an alkali aqueous solution under exposure to infrared laser light. Description will be given to recording layers of the two types below.

[Positive-type Recording Layer]

As positive-type recording layers, there are recording layers of an "release of interaction" type (a heat-sensitive positive type) and an "acid-catalyst decomposition" type. These positive-type recording layers are made water-soluble or alkali-soluble through release of bonds between polymers that have constituted the layer, caused by an acid or heat generated by light irradiation or heating. Thus, the recording layer is removed by development to form a image portion. A resin composition recited in the invention is preferably used in a positive-type recording layer. That is because the effect of the invention is so particular in this case, that an excellent discrimination is obtained, by exerting not only an effect of improving a development resistance in an image portion but also a dissolution accelerating effect in a non-image portion by a developing solution.

<"Release of Interaction" Type (Heat-sensitive Type)>

A recording layer of the "release of interaction" type is a layer containing an alkali-soluble resin and an infrared absorbing agent and transformed into water-soluble or alkali-soluble through a process of release of bonds of polymers that have constituted the layer and the like, by heat energy generated by light irradiation or heating and removed by development to form a non-image portion.

As alkali-soluble resins and infrared absorbing agents in the "release of interaction" type, while there are used the components (A) and (B) contained in a resin composition recited in the invention, other known compounds can also be used together with these components if desired.

<Acid-catalyst Decomposition Type>

An acid-catalyst decomposition type recording layer is a layer containing, as indispensable components, a compound (an acid generating agent) generating an acid by an action of light or heat and a compound (an acid decomposable compound) increasing a solubility thereof in an alkali developing solution by cleavage of chemical bonds therein with thus-generated acid as a catalyst. Under workings of such a mechanism of decomposition with an acid-catalyst in the layer, an image forming material of an acid-catalyst decomposition type is also called an image forming material of a chemical amplification type.

In an acid-catalyst decomposition type recording layer, there may be further incorporated a polymer compound, which is to be a binder component of the layer of this type. As polymer compounds, each being the binder component, there may also be, for example, used an alkali-soluble resin such as a component (A) described above, or alternatively, an acid decomposable compound itself described later may be a polymer compound exerting a function of a binder component or a precursor thereof.

In an acid-catalyst decomposition type recording layer, there may be incorporated an infrared absorbing agent (for example, a component (B) described above or the like) used for the purpose to increase a sensitivity.

Furthermore, in the case where an acid-catalyst decomposition type recording layer is provided in plural layers as a component of a multilayer structure, the recording layer is preferably formed on an exposure surface as the uppermost layer.

(Acid Decomposable Compound)

A compound increasing a solubility thereof in an alkali developing solution through cleavage of chemical bonds therein with an acid as a catalyst can be expressed as, in other words, a compound having a connecting group decomposable by an acid in a molecule. As such a compound, there can be used a compound that is described as "a compound (b) having at least one bond decomposable by an acid" in JP-A No. 9-171254. As bonds decomposable by an acid, there can be preferably exemplified a-$(CH_2CH_2O)_n$-group, wherein n indicates an integer of 2 to 5, and the like.

Among such compounds, preferably used are compounds represented by the following general formula (I) from the view point of sensitivity and developability:

General formula (I)

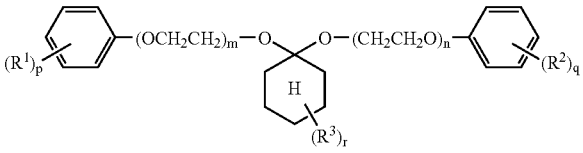

In the general formula (I), $R^1$, $R^2$ and $R^3$ each represent a hydrogen atom, an alkyl group having 1 to 5 carbon atoms, an alkoxy group having 1 to 5 carbon atoms, a sulfo group, a carboxyl group or a hydroxyl group; p, q and r each represent an integer of 1 to 3; and m and n each represent an integer of 1 to 5.

In the general formula (I), an alkyl group indicated by $R^1$, $R^2$ and $R^3$ may be linear or a branched, and a methyl group, an ethyl group, a propyl group, an isopropyl group, a butyl group, a tert-butyl group, a pentyl group, alkoxy groups such as a methoxy group, an ethoxy group, a propoxy group, an isopropoxy group, a butoxy group, a tert-butoxy group, a pentoxy group, and the like can be cited; and the sulfo group and carboxyl group include salts thereof. Among compounds represented by the general formula (I), especially preferable are compounds having m and n of 1 or 2. Compounds represented by the general formula (I) can be synthesized according to a known method.

As acid decomposable compounds applicable in the invention, there can be used compounds each having a C—O—C bond described in JP-A Nos. 48-89603, 51-120714, 53-133429, 55-12995, 55-126236 and 56-17345; compounds each having Si—O—C bond described in JP-A Nos. 60-37549 and 60-121446; and other acid decomposable compounds described in JP-A Nos. 60-3625 and 60-10247. In addition, compounds each having a Si—N bond described in JP-A No. 62-222246; carbonate esters described in JP-A No. 62-251743; orthocarbonate esters described in JP-A No. 62-209451; orthotitanate esters described in JP-A No. 62-280841; orthosilicate esters described in JP-A No. 62-280842; acetals, ketals and orthocarboxylate esters described in JP-A Nos. 63-010153, 9-171254, 10-55067, 10-111564, 10-87733, 10-153853, 10-228102, 10-268507, 10-282648, 10-282670 and EP No. 0884547A1; and compounds each having a C—S bond described in JP-A No. 62-244038, can be cited.

Among the acid decomposable compounds described above, especially preferable are compounds each having a C—O—C bond, compounds each having a Si—O—C bond, orthocarbonate esters, acetals, ketals and silyl ethers described in JP-A Nos. 53-133429, 56-17345, 60-121446, 60-37549, 62-209451, 63-010153, 9-171254, 10-55067, 10-111564, 10-87733, 10-153853, 10-228102, 10-268507, 10-282648, 10-282670 and EP No. 0884647A1.

Among the acid decomposable compounds, preferably used are polymer compounds each having acetal or ketal portions in a repeated manner in a main chain and solubility of which in an alkali developing solution increases by an acid generated.

The acid decomposable compounds may be used alone or in combination of two or more kinds of them. An addition amount is preferably from 5 to 70% by mass and preferably from 10 to 50% by mass and more preferably from 15 to 35% by mass relative to the total solids content in a chemical amplification layer. If the addition amount is less than 5% by mass, a blemish in a non-image portion is easily generated, while the addition amount exceeding 70% by mass causes an insufficient film strength of an image portion, both case being not preferable.

[Negative-type Recording Layer]

As negative-type recording layers, recording layers of a radical polymerization type and an acid-catalyst cross-linking type (including a cationic polymerization type) can be cited. These recording layers form image portions by a process in which a radical or an acid generated by light irradiation or heating works as an initiator or a catalyst to cause compounds constituting a recording layer to polymerize or cross-link, thus the compounds are cured.

<Radical Polymerization Type>

A radical polymerization type recording layer contains a compound generating a radial by light or heat (hereinafter referred to as a radical generating agent) and a radically polymerizable compound (hereinafter referred to as a polymerizable compound). A radical is generated from a radical generating agent in an exposed portion by irradiation of infrared laser light and the like, which works as an initiator, to cause the polymerizable compound to conduct a radical polymerization reaction. Thus, the polymerizable compound is cured and an image portion is formed. The combination of a radical generating agent and a polymerizable compound can be properly selected from known combinations as far as strength of a film to be formed by a radical polymerization satisfies requirements for a recording layer. Furthermore, in order to enhance reactivity of a radical generating agent, there can also be simultaneously used an accelerator such as an onium salt, a reducing agent or the like. As components that can be used in a radical polymerization layer, there can be preferably used: a compound described as a constituent component of a heat-polymerizable recording layer in JP-A No. 8-108621; and a compound as a constituent component of a recording layer in JP-A No. 9-34110.

(Radical Generating Agent)

As radical generating agents used in a radical polymerization type recording layer, there can be used known radical polymerization initiators generally used for a high polymer synthetic reaction through radical polymerization without imposing any specific limitation on a particular initiator and there are exemplified azobisnitril based compounds such as 2,2'-azobisisobutylonitril, 2,2'-azobispropionitril and the like; organic peroxides such as peroxybenzoil, peroxylauroyl, peroxyacetyl, t-butyl perbenzoate, cumene hydroperoxide, di-t-butyl peroxide, diisopropylperoxy dicarbonate, t-butylperoxyisopropyl carbonate, peracids, alkylperoxy carbamates, nitrosoarylacylamines; inorganic peroxides such as potassium persulfate, ammonium persulfate, potassium perchlorate and the like; azo or diazo type compounds such as diazoaminobenzene, p-nitrobenzene diazonium, azobis substituted alkanes, diazothio ethers, arylazosulfones and the like; tetraalkylthiuram disulfides such as nitrosophenyl urea, tetramethylthiuram disulfide and the like; diaryl disulfides such as dibenzoyl disulfide and the like; dialkylxanthogenic acid disulfides; aryl sulfinic acids; arylalkylsulfones; 1-alkanesulfinic acids and the like.

In the case where recording is conducted on a radical polymerization type recording layer recited in the invention with an infrared laser, a sufficient sensitivity can be achieved even with a radical generating agent having a large activation energy since a temperature to which an exposed surface is raised is 600° C. or higher, depending on the intensity of energy of laser light.

An activation energy for generation of a radical from a radical generating agent is preferably 30 kcal/mol or more, and as such materials satisfying this condition, an azobisnitril based compounds, organic peroxides and the like can be cited. Among them, preferable is a compound excellent in stability at an normal temperature, with a high decomposition rate when being overheated, and assuming an achromatic color in decomposition and as such compounds, peroxybenzoil, 2,2'-azobisisobutylonitril and the like can be cited.

The radical generating agents described above may be used either alone or in combination of two or more kinds of them, and a radical generating agent is incorporated in an amount of 0.5 to 30% by mass and preferably of 2 to 10% by mass relative to total solids content of a radical polymerization layer.

There can be preferably used compounds described later, each generating a radical by an interaction with an onium salt. Specifically, halides (α-haloacetophenones, trichloromethyltriazines and the like); azo compounds; aromatic carbonyl compounds (benzoin esters, ketals, acetophenones, o-acyloxyiminoketones, acylphosphine oxides and the like); hexaarylbisimidazol compounds; peroxides and the like can be cited. And bisimidazol derivatives disclosed as (A-1) to (A-4) on page 16 of JP-A No. 9-34110 is preferable.

A radical generating agent of the latter achieves its high sensitivity by an interaction with an onium salt. As onium salts that can be used together with the radical generating agent, a phosphonium salt, a sulfonium salt, an iodonium salt and an ammonium salt described in paragraphs [0022] to [0049] of JP-A No. 9-34110 can be cited.

An addition amount of an onium salt differs depending on a kind and a way of usage of the onium salt, and is preferably in an amount of 0.05 to 50% by mass relative to the total solids content of a recording layer.

Onium salts such as an iodonium salt, a sulfonium salt, a phosphonium salt, a diazonium salt and the like preferably used as an acid generating agent in an "acid-catalyst cross-linking type" recording layer described later, can be used alone as a radical generating agent without simultaneous use of a radical generating agent described above. And its addition amount differs depending on kind and way of use, and is preferably in an amount of 0.05 to 50% by mass relative to total solids content of a recording layer.

(Polymerizable Compound)

As polymerizable high molecular compounds that polymerizes to cure with the help of a radical generated from a radical generating agent, there can be used known monomers each having a polymerizable group without specific limitation on a particular monomer. Specific examples of such monomers include mono-functional acrylate ester such as 2-ethylhexylacrylate, 2-hydroxyethylacrylate, 2-hydroxypropylacrylate and the like and derivatives thereof; compounds obtained by replacing the acrylate of each of the above-mentioned esters with methacrylate, itaconate, crotonate, maleate or the like; bifunctional acrylate esters such as polyethylene glycol diacrylate, pentaerythritol diacrylate, bisphenol A diacrylate, diacrylate of an ε-caprolactone adduct of hydroxypivalic acid neopentyl glycol and the like, and derivatives thereof; compounds obtained by replacing the acrylate of each of the above-mentioned esters with methacrylate, itaconate, crotonate, maleate or the like; and polyfunctional acrylates such as trimethylolpropane tri (meta)acrylate, dipentaerythritol pentaacrylate, dipentaerythritol hexaacrylate, pyrogallol triacrylate and the like, and derivatives thereof; and compounds by replacing the acrylate of each of the esters with methacrylate, itaconate, crotonate, maleate or the like. Furthermore, there can be preferably used so-called prepolymers obtained by incorporating acrylic acid or methacrylic acid into an oligomer having a proper molecular weight and further imparting photopolymerizability to the oligomer.

In addition, there can be preferably used compounds described in JP-A Nos. 58-212994, 61-6649, 62-46688, 62-48589, 62-173295, 62-187092, 63-67189, 1-244891 and the like. And furthermore, compounds described in "11290no Kagakushouhin" (11290 Chemical Comodities) published by The Chemical Daily Co., Ltd., pp. 286 to 294 and compounds described in "UV-EB Kouka Hando bukku (Genryouhen)" (UV-EB Hardening Manual (Raw Material version)) published by Kobunshi-Kankokai, pp. 11 to 65 are preferably used.

Among them, preferable in the invention are compounds each having two or more acrylic groups, or two or more methacrylic groups, and a molecular weight thereof is preferably 10,000 or less and more preferably 5,000 or less. In the invention, as polymerizable compounds, there can be used monomers and prepolymers each having a polymerizable group including the compounds exemplified above, either alone or in combination of two or more kinds thereof, as far as no inconvenience arises with respect to compatibility and affinity therebetween, according to a purpose.

A compound having an ethylenic unsaturated group is preferably incorporated into a recording layer in an amount of 20 to 80% by mass and more preferably of 30 to 60% by mass as a solid content.

(Binder Resin)

In a radical polymerization type recording layer, a binder resin is preferably used from the viewpoint of improvement on film properties. As binder resins, a polyester type resin, a polyvinyl acetal type resin, a polyurethane type resin, a polyamide type resin, a cellulose type resin, an olefin type resin, a vinyl chloride type resin, a (meta)acrylic type resin, a styrene type resin, polycarbonate, polyvinylalcohol, polyvinylpyrrolidone, polysulfone, polycaprolactone resin, polyacrylonitril resin, urea resin, epoxy resin, phenoxy resin, a rubber type resin and the like, can be cited. Furthermore, there can be preferably used resins each having an unsaturated bond therein, for example diallylphthalate resin and derivatives thereof, chlorinated polypropylene and the like, according to an application, since the resins each can be polymerized with a compound having an ethylenic unsaturated bond described above. As binder resins, the resins described above can also be used either alone or in combination of two or more kinds thereof.

A binder resin is preferably used in an amount of 500 parts by mass or less and more preferably used in an amount of 200 parts by mass or less per 100 parts by mass of a polymerizable compound.

In such a radical polymerization type recording layer, increase in sensitivity and acceleration of a radical polymerization reaction can be realized by incorporating an infrared absorbing agent like a component (B) described above.

(Other Compounds)

In a radical polymerization type recording layer, various kinds of additives can be used properly, which can be used simultaneously with a photopolymerizable compound known conventionally.

As additives, there are heat-polymerization inhibitors, which include, specifically, quinone type and phenol type compounds such as hydroquinone, pyrogallol, p-methoxyphenol, catechol, β-naphthol, 2,6-di-t-butyl-p-cresol, which is used in an amount of 10 parts by mass or less and preferably in an amount of 0.01 to 5 parts by mass, per 100 parts by the sum of masses of a polymerizable compound having an ethylenic unsaturated bond and a binder resin.

As compounds each of which can be added as an oxygen quencher, a compound such as N,N-dialkylaniline derivatives described in from column 11, line 58 to column 12, line 35 of U.S. Pat. No. 4,772,541, can be cited.

Furthermore, a plasticizer can be used in order to improve film properties. Examples of such plasticizers include phthalate esters, trimellitate ester, adipate esters, other saturated or unsaturated carboxylate esters, citrate esters, epoxidized soya oil, epoxidized linseed oil, epoxy stearates, orthophosphate esters, phosphite esters, glycol esters and the like.

It is preferable that an acid generating agent is simultaneously used as an additive, generating an acid by heating, and accelerating decomposition of a radical generating agent. As such acid generating agents, there can be used compounds shown in detailed description of an acid-catalyst cross-linking type recording layer described below.

In a planographic printing plate precursor using a radical polymerization type recording layer as a recording layer, the radical polymerization type recording layer can be formed in a procedure in which components described above are properly selected and dissolved into a proper solvent and the solution thus prepared is coated on a substrate, wherein a coating amount after drying is preferably in the range of from 0.01 to 5.0 g/m$^2$.

Note that in the case where a radical polymerization type recording layer is used as a recording layer, an overcoat layer impermeable to oxygen may also be provided adjacent to the recording layer in order to prevent polymerization inhibition caused by oxygen. As materials of an overcoat layer, water-soluble resins such as polyvinylalcohol, carboxymethylcellulose, hydroxyethylcelluloe, methylcellulose, polyvinylpyrolidone and the like are preferable, and a film thickness is properly in the range of from 0.2 to 3 μm.

Into an overcoat layer, there may be added a dye or a pigment, not absorbing light from a light source, as a filter, if necessary.

<Acid-Catalyst Cross-linking Type>

An acid-catalyst cross-linking type recording layer, comprises a compound generating an acid by irradiation of light or heating (hereinafter referred to as an "acid generating agent"), a compound that can cross-link with thus-generated acid as a catalyst (hereinafter referred to as a cross-linking agent) and in addition, a binder polymer, for forming a layer containing these agents, and which can react with the cross-linking agent in the presence of an acid. In the acid-catalyst cross-linking type recording layer, an acid generated by decomposition of an acid generating agent by irradiation of light or heating accelerates an action of the cross-linking agent to form a rigid cross-linked structure between the cross-linking agents or between the cross-linking agent and the binder polymer, thereby the alkali-solubility of the recording layer is reduced and the recording layer becomes insoluble in a developing solution.

As an acid-catalyst cross-linking type recording layer having such property, there can be used components of a layer having a property similar to that of a known recording layer. There can be exemplified: resol resin, novolak resin, latent broenstead acid and a compound described as a component of a layer made of a radiation sensitive composition containing an infrared absorbing agent. All of these examples are described in JP-A No. 7-20629. Herein, the term "latent broenstead acid" means a precursor that generates the acid by decomposition thereof and has both natures as an acid generating agent and an acid cross-linking agent in the invention. Broenstead acid is thought to catalyze a matrix forming reaction between resol resin and novolak resin and as Broenstead acids proper for this purpose, there are exemplified trifluoromethanesulfonic acid and hexafluorophosphonic acid.

An ionic latent Broenstead acid is preferably used and its examples include onium salts, especially, an iodonium salt, a sulfonim salt, a phophonium salt, a selenonium salt, a diazonium salt, and an arsonium salt. A nonionic latent Broenstead acid can also be preferably used and its examples include following compounds: $RCH_2X$, $RCHX_2$, $RCX_3$, $R(CH_2X)_2$ and $R(CH_2X)_3$, wherein X represents Cl, Br, F, $CF_3$ or $SO_3$ and R represents an aromatic group, an aliphatic group or a group obtained by bonding an aromatic group to an aliphatic group.

Furthermore, there preferably exemplified a recording layer containing an acid cross-linking agent and a polymer binder described in JP-A No. 11-95415. This recording layer, which can be applied to the invention, contains a compound that can generate an acid under irradiation of active light such as salts such as a diazonim salt, a phosphonium salt, a sulfonium salt and an iodonium salt; an organic halide compound; orthoquinone-diazosulfonylchloride; an organometal/organic halide compound; compounds each having at least one group that can cross-link in the presence of an acid described above such as amino compounds each having at least two groups selected from alkoxymethylgroups, methylol groups, acetoxymethyl groups or the like, as functional groups, aromatic compounds having at least 2 substituents thereon, and having a functional group such as alkoxymethyl groups, methylol groups, acetoxymethyl groups or the like, resol resin, furan resin, or an acrylic resin synthesized from a specified monomer.

An acid-catalyst cross-linking type recording layer recited in the invention comprises an acid generating agent, a cross-linking agent, a binder polymer and others and description will be next given of the compounds individually.

(Acid Generating Agent)

A compound generating an acid under irradiation of light or by heating (an acid generating agent) means a compound that is decomposed to generate an acid under irradiation of infrared or by heating at a temperature of 100° C. or higher. As acids generated, strong acids with a pKa value of 2 or less, such as sulfonic acid, hydrochloric acid and the like is preferable.

As acid generating agents preferably used in the invention, onium salts such as an iodonium salt, a sulfonium salt, a phosphonium salt, a diazonium salt and the like can be cited. Specifically, there can also be exemplified compounds described in U.S. Pat. No. 4,708,925 and JP-A No. 7-20629. Especially preferable are an iodonium salt, a sulfonium salt and a diazonium salt each having a sulfonic ion as a counter ion. As diazonium salts, preferable examples include a diazonium compound described in U.S. Pat. No. 3,867,147, a diazonium compound described in U.S. Pat. No. 2,632,703, diazo resins described in JP-A Nos. 1-102456 and 1-102457, benzyl sulfonates described in U.S. Pat. Nos. 5,135,838 and 5,200,544, active sufonate esters and disulfonyl compounds described in JP-A Nos. 2-100054, 2-100055 and 9-197671, and haloalkyl-substituted S-triazines described in JP-A No. 7-271029.

An acid generating agent described above is added in an acid-catalyst cross-linking type layer in an amount of 0.01 to 50% by mass, preferably of 0.1 to 40% by mass and more preferably of 0.5 to 30% by mass on the basis of the total solids content of the acid-catalyst cross-linking type recording layer. If the addition amount is less than 0.01% by mass, no image is obtained. If the addition amount exceeds 50% by mass, blemishes are generated in a non-image portion at printing.

The compounds may be used either alone or in combination of two or more kinds thereof. Note that since an acid generating agent cited here can also be decomposed under irradiation of ultraviolet, image recording can be performed by irradiation of not only infrared but also ultraviolet with the recording layer described above.

(Acid Cross-linking Agent)

As cross-linking agents used in an acid-catalyst cross-linking type recording layer, any compound can be used as far as it performs cross-linking with the help of an acid, without specific limitation is imposed on a particular compound. Preferable examples include a phenol derivative represented by the following general formula (II) (hereinafter referred to as a low molecular weight phenol derivative), a polynuclear phenolic cross-linking agent, having at least 3 phenol rings in a molecule that have 2 or 3 hydroxymethyl groups on each ring, and represented by the following general formula (III), a mixuture of the low molecular phenol derivative with the polynuclear phenolic cross-linking agent and/or resol resin; and the like.

General formula (II)

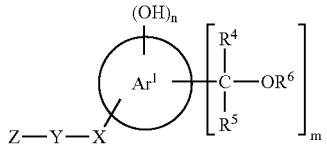

Y:

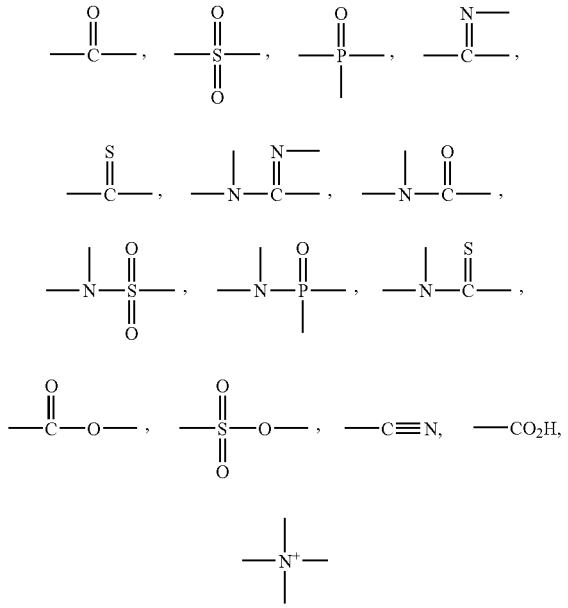

In the formula (II), $Ar^1$ represents an aromatic hydrocarbon ring that may have a substituent thereon; $R^4$ and $R^5$ may be identical to or different from each other, each representing a hydrogen atom or a hydrocarbon group having 12 or less carbon atoms; $R^6$ represents a hydrogen or a hydrocarbon group having 12 or less carbon atoms; m represents an integer of 2 to 4; n represents an integer of 1 to 3; X represents a divalent connecting group; Y represents a connecting group with a valence number of 1 to 4 or a functional group having a hydrogen atom at the terminal thereof, each group having of a partial structure above described; Z does not exist in the case where Y is a terminal group or alternatively, indicates connecting groups each with a valence number of 1 to 4 or functional groups, existing according to the number of connecting groups Y.

General formula (III)

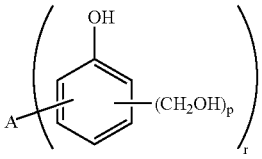

In the formula (III), A represents an r-valent hydrocarbon connecting group having 1 to 20 carbon atoms, r represents an integer of 3 to 20 and p represents an integer of 2 or 3.

Detailed description is given of a phenol derivative represented by the general formula (II) in paragraphs [0098] to [0155] of JP-A No. 2001-166462 previously filed by the applicant of this application and detailed description is also given of a polynuclear phenolic cross-linking agent, represented by the general formula (III), and having 3 or more phenol rings each having 2 or 3 hydroxymethyl groups thereon in a molecule in paragraphs [0156] to [0165] of JP-A No. 2001-166462.

The cross-linking agents may be used either alone or in combination of two or more kinds thereof.

A cross-linking agent described above is added to an acid-catalyst cross-linking type recording layer in an amount of 5 to 70% by mass and preferably of 10 to 65% by mass with respect to the solids content in the acid-catalyst cross-linking type recording layer. If the addition amount of a cross-linking agent is less than 5% by mass, a film strength of an image portion is degraded when having conducted image recording, while if exceeding 70% by mass, it is not preferable with respect to shelf-stability.

As binder polymers that can be used in an acid-catalyst cross-linking type recording layer, a polymer having an aromatic hydrocarbon ring, on which a hydroxyl group or an alkoxy group bonded directly, on a side chain or a main chain, can be cited. As alkoxy groups, those having 20 or less carbon atoms are preferable from the viewpoint of sensitivity. As aromatic hydrocarbon rings, a benzene ring, a naphthalene ring and an anthracene ring are preferable from the viewpoint of availability of raw material. An aromatic hydrocarbon ring may have a substituent other than a hydroxyl group or an alkoxy group, such as a halogen atom, a cyano group or the like, whereas it is preferable not to have a substituent other than a hydroxyl group or an alkoxy group in terms of sensitivity.

In an acid-catalyst cross-linking type recording layer, preferably used binder polymers are polymers each having a structural unit represented by the following general formula (IV), or phenol resins such as a novolak resin.

General formula (IV)

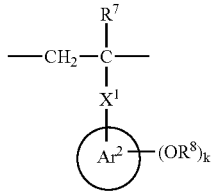

In the general formula (IV), $Ar^2$ represents a benzene ring, a naphthalene ring or an anthracene ring, $R^7$ represents a hydrogen atom or a methyl group, $R^8$ represents a hydrogen atom or an alkoxy group having 20 or less carbon atoms, $X^1$ represents a single bond or a divalent connecting group, containing one or more kinds of atoms selected from the group consisting of C, H, N, O and S, and having 0 to 20 carbon atoms and k represents an integer of 1 to 4.

In an acid-catalyst cross-linking type recording layer, as binder polymers, there may be used not only a homopolymer constructed of a structural unit represented by the general formula (IV), but also a copolymer having a structural unit derived from other known monomer together with this specific structural unit.

A content of a structural unit represented by the general formula (IV) contained in the copolymer is preferably from 50 to 100% by mass and more preferably from 60 to 100% by mass, A weight average molecular weight of a binder polymer described above that can be used is preferably 5,000 or higher and more preferably from 10,000 to 300,000, and a number average molecular weight thereof is preferably 1,000 or higher and more preferably from 2,000 to 250,000. A degree of polydispersion (weight average molecular weight/number average molecular weight) is preferably one or more and more preferably in the range of from 1.1 to 10.

The binder polymers may be any of a random polymer, a block polymer, a graft polymer, and the like, and is preferably a random polymer.

Next, description will be given of a phenol resin such as a novolak resin.

As novolak resins preferably used in an acid-catalyst cross-linking type recording layer, there are exemplified a phenol novolak, various kinds of o-, m- and p-cresol novolak resins and copolymers thereof, and novolak resins using phenols each substituted by a halogen atom, an alkyl group or the like.

A weight average molecular weight of a novolak resin described above is preferably 1,000 or higher and more preferably in the range of 2,000 to 20,000 and a number average molecular weight is preferably 1,000 or higher and more preferably in the range of 2,000 to 15,000. A degree of polydispersion is preferably one or more and more preferably in the range of 1.1 to 10.

It is also a preferable to use a polymer having a heterocyclic group having an unsaturated bond in a ring as a binder polymer.

The term "heterocycle" means a ring containing one or more hetero atoms different from a carbon atom, as an atom or atoms constructing the cycle. As hetero atoms used, preferable are a nitrogen atom, an oxygen atom, a sulfur atom and a silicon atom. It is thought that by using a polymer having such heterocyclic group, a reaction is caused with ease in terms of a chemical structure by a function of a lone pair present on this heterocycle, which leads to forming of a film with a good printing durability.

The binder polymers used in the invention, described above, may be used either alone or in mixture of two or more kinds thereof. These binder polymers are added to an acid-catalyst cross-linking type recording layer in an amount of 20 to 95% by mass and preferably, of 40 to 90% by mass with respect to all solids content of the acid-catalyst cross-linking type recording layer. If the addition amount is less than 20% by mass, strength of a resultant image portion becomes insufficient when having formed an image. On the other hand, if the addition amount exceeds 95% by mass, no image is formed.

In an acid-catalyst cross-linking type recording layer as well, a sensitivity can be increased by incorporating an infrared absorbing agent such as a component (B) described above.

In forming an acid-catalyst cross-linking type recording layer, various kinds of additives such as a surfactant can be simultaneously used for the purpose of improving coatability and a film quality.

While description is given of the positive and negative-type recording layer as shown above, there can be used an alkali soluble resin (A) described above as a binder polymer and an infrared absorbing agent (B) described above for the purpose of increasing a sensitivity in a recording layer, arbitrarily.

[Other Components]

Various additives can be further added, if necessary, to positive-type or negative-type recording layer in which a resin composition recited in the invention is preferably used.

As additives used in a positive-type recording layer, there are preferably added so-called dissolution inhibitors increasing a dissolution inhibiting function of an alkaline water-soluble polymer (an alkali-soluble resin) in a developing solution, such as other onium salts, an aromatic sulfone compound, an aromatic sulfonate ester, a polyfunctional amine compound and the like. Among them, compounds that are thermally decomposable and substantially reduces a solubility of an alkali-soluble resin in the undecomposed state, such as an onium salt, an o-quinonediazide compound, an alkyl sulfonate ester and the like can be preferably used simultaneously, in terms of improving a dissolution inhibiting property of an image portion in the developing solution. As decomposable dissolution inhibitors, preferable are onium salts such as a diazonium salt, an iodonium salt, a sulfonium salt, an ammonium salt, and an o-quinonediazide compound, and more preferably are onium salts such as a diazonium salt, an iodonium salt and a sulfonium salt.

As preferable onium salts used in the invention, there are exemplified: diazonium salts described in S. I. Schlesinger, Photogr. Sci. Eng., 18, 387 (1974), T. S. Bal et al, Polymer, 21, 423 (1980) and JP-A No. 5-158230; ammonium salts described in U.S. Pat. Nos. 4,069,055, 4,069,056 and JP-A No. 3-140140; phosphonium salts described in D. C. Necker et al, Macromolecules, 17, 2468 (1984), C. S. Wen et al, Teh. Proc. Conf. Rad. Curing ASIA, p. 478 Tokyo, October (1988), U.S. Pat. Nos. 4,069,055 and 4,069,056; iodonium salts described in J. V. Crivello et al, Macromolecules, 10(6), 1307 (1977), Chem. & Eng. News, November 28, p. 31 (1988), EP No. 104,143, U.S. Pat. Nos. 5,041,358, 4,491,628, JP-A Nos. 2-150848 and 2-296514; sulfonium salts described in J. V. Crivello et al, Polymer J. 17, 73 (1985), J. V. Crivello et al, J. Org. Chem., 43, 3055, (1978), W. R. Watt et al, J. Polymer Sci., Polymer Chem. Ed., 22, 1789 (1984), J. V. Crivello et al, Polymer Bull., 14, 279 (1985); J. V. Crivello et al, Macromolecules, 14 (5), 1141 (1981), J. V. Crivello et al, J. Polymer Sci., Polymer Chem. Ed., 17, 2877 (1979), EP Nos. 370,693, 233,567, 297,443, 297,442, U.S. Pat. Nos. 4,933,377, 3,902,114, 5,041,358, 4,491,628, 4,760,013, 4,734,444, 2,833,827, DP Nos. 2,904,626, 3,604,580 and DP No. 3,604,581; selenonium salts described in J. V. Crivello et al, Macromolecules, 10(6), 1307 (1977) and J. V. Crivello et al, J. Polymer Sci., Polymer Chem. Ed., 17, 1047 (1979); and arsonium salts described in C. S. Wen et al, Teh, Proc. Conf. Rad. Curing ASIA, p. 478 Tokyo, October (1988).

Among the onium salts, a diazonium salt is especially preferable from the view point of a dissolution inhibiting performance and thermal decomposability. Especially preferable are a diazonium salt represented by the general formula (I) described in JP-A No. 5-158230 and a diazonium salt represented by the general formula (1) described in JP-A No. 11-143064, and the most preferable is a diazonium salt, represented by the general formula (1), which has a small absorption wavelength in a visible light region, and described in JP-A No. 11-143064.

As counter ions of onium salts, there is exemplified tetrafluoroboric acid, hexafluorophosphoric acid, triisopropylnaphthalene sulfonic acid, 5-nitro-o-toluene sulfonic acid, 5-sulfosalycilic acid, 2,5-dimethylbenzene sulfonic acid, 2,4,6-trimethylbenzene sulfonic acid, 2-nitrobenzene sulfonic acid, 3-chlorobenzene sulfonic acid, 3-bromobenzene sulfonic acid, 2-fluorocaprylnaphthalene sulfonic acid, dodecylbenzene sulfonic acid, 1-naphthol-5-sulfonic acid, 2-methoxy-4-hydroxy-5-benzoil-benzene sulfonic acid and para-toluene sulfonic acid. Among them, especially preferable are alkylaromatic sulfonic acids such as hexafluorophosphoric acid, triisopropylnaphthalene sulfonic acid and 2,5-dimethylbenzene sulfonic acid.

As a preferable quinonediazide, there is exemplified an o-quinonediazide compound. An o-quinonediazide compound used in the invention is a compound that has at least one o-quinonediazide group and increases its alkali-solubility by thermal decomposition, and such compounds of various structures can be used. That is, o-quinonediazide enhances dissolution of a photosensitive material through both effects of loss of a dissolution inhibiting property toward a binder by thermal decomposition and transformation into an alkali-soluble material of o-quinonediazide itself. As o-quinonediazide compounds used in the invention, there can be used, for example, a compound described in J. Kosar, "Light Sensitive Systems", John Willey & Sons. Inc. pp. 339 to 352, but especially preferable are a sulfonate ester or sulfonic amide of an o-quinonediazide obtained by reacting the o-quinonediazide with one of various kinds of aromatic polyhydroxy compounds or one of aromatic amino compounds. Furthermore, there are preferably used: an ester of benzoquinone(1,2)-diazide sulfonic chloride or naphthoquinone-(1,2)-diazide-5-sulfonic chloride with pyrogallol-aceton resin as described in JP-B No. 43-28403; and an ester of benzoquinone-(1,2)-diazidesulfonic chloride or naphthoqinone-(1,2)-diazide-5-sulfonic chloride with phenol-formaldehyde resin described in U.S. Pat. Nos. 3,046,120 and 3,188,210.

Furthermore, similarly, there are preferably used an ester of naphthoquinone-(1,2)-diazide-4-sulfonic chloride with phenol-formaldehyde resin or cresol-formaldehyde resin and an ester of naphthoquinone-(1,2)-diazide-4-sulfonic chloride with pyrogallol-acetone resin. As other useful o-quinonediazide compounds, there are many compounds reported and known in a number of patents. The examples include compounds described in specifications of, for example, JP-A Nos. 47-5303, 48-63802, 48-63803, 48-96575, 49-38701, 48-13354, JP-B Nos. 41-11222, 45-9610, 49-17481, U.S. Pat. Nos. 2,797,213, 3,454,400, 3,544,323, 3,573,917, 3,674,495, 3,785,825, BP Nos. 1,227, 602, 1,251,345, 1,267,005, 1,329,888, 1,330,932 and DP No. 854,890.

An addition amount of an onium salt as a decomposable dissolution inhibitor, and/or an o-quinonediazide compound, is preferably in the range of 1 to 10% by mass, more preferably in the range of 1 to 5% by mass and especially preferably in the range of 1 to 2% by mass, with respect the total solids content of a recording layer. The compounds described above can be used alone or in a form of a mixture of several kinds thereof.

An addition amount of additives excluding an o-quinonediazide compound is preferably in an amount of 0.1 to 5% by mass, more preferably of 0.1 to 2% by mass and especially preferably of 0.1 to 1.5% by mass. An additive and a binder recited in the invention are preferably incorporated into the same layer.

Furthermore, a dissolution inhibitor having no decomposability may be simultaneously used together in a recording layer and as such dissolution inhibitors, a sulfonate ester, a phosphate ester, an aromatic carboxylate ester, an aromatic disulfone, a carboxylic anhydride, an aromatic ketone, an aromatic aldehyde, an aromatic amine, an aromatic ether and the like detailed in JP-A No. 10-268512; an acid-coloring dye, having a lactone structure, an N,N-diarylamide structure or diarylmethylimino structure, and working as a coloring agent detailed in JP-A No. 11-190903; and a nonionic surfactant detailed in JP-A No. 2000-105454; and the like, can be cited.

As additives used in both of a positive-type recording layer and a negative-type recording layer, there can be used in both recording layers in common: cyclic acid anhydrides, phenols and organic acids for the purpose of increasing a sensitivity. Furthermore, a surfactant, an image coloring agent and a plasticizer, described later, are likewise additives that can be used commonly in both positive-type and negative-type recording layers.

As cyclic acid anhydrides, there can be used: phthalic anhydride, tetrahydrophthalic anhydride, hexahydrophthalic anhydride, 3,6-endoxy-Δ4-tetrahydrophthalic anhydride, tetrachlorophthalic anhydride, maleic anhydride, chloromaleic anhydride, α-phenylmaleic anhydride, succinic anhydride, pyromellitic anhydride and the like described in U.S. Pat. No. 4,115,128. As phenols, bisphenol A, p-nitrophenol, p-ethoxyphenol, 2,4,4'-trihydroxybenzophenone, 2,3,4-trihydroxybenzophenone, 4-hydroxybenzophenone, 4,4',4"-trihydroxytriphenylmethane, 4,4',3",4"-tetrahydroxy-3,5,3',5'-tetramethyltriphenylmethane and the like can be cited. Furthermore, as organic acids, sulfonic acids, sulfinic acids, alkylsulfates, phosphonic acids, phosphate esters, carboxylic acids and the like described in JP-A Nos. 60-88942, 2-96755 and the like can be cited.

The total content of a cyclic acid anhydride, a phenol and an organic acid described above in a recording layer, is preferably from 0.05 to 20% by mass, more preferably from 0.1 to 15% by mass and most preferably from 0.1 to 10% by mass.

Furthermore, in addition to the compounds described above, there can be properly used according to a purpose: an epoxy compound; vinyl ethers; furthermore, a phenol compound having a hydroxymethyl group and a phenol compound having an alkoxymethyl group described in JP-A No. 8-276558; and a cross-linkable compound having a alkali-dissolution inhibiting property, described in JP-A No. 11-160860.

The following compounds can be added into a recording layer coating solution recited in the invention in order to enhance stability of development toward developing conditions, which are: a nonionic surfactant as described in JP-A Nos. 62-251740 and 3-208514; an amphoteric surfactant as described in JP-A Nos. 59-121044 and 4-13149; a siloxane type compound as described in EP No. 950517; and a copolymer of a fluorine-containing monomer as described in JP-A No. 11-288093.

Specific examples of nonionic surfactant include sorbitan tristearate, sorbitan monopalmitate, sorbitan triolate, stearic acid monoglyceride, polyoxyethylenenonylphenyl ether and the like. Specific examples of amphoteric surfactant include alkyldi(aminoethyl)glycine, alkylpolyaminoethylglycine hydrochloric acid salt, 2-alkyl-N-carboxyethyl-N-hydroxyethylimidazoliniumbetain, N-tetradecyl-N,N-betain type (for example, made by DAI-ICHI KOGYO SEIYAKU CO., LTD. with a trade name "AMOGEN K").

As siloxane type compounds, preferable is a block copolymer of dimethyl siloxane and polyalkylene oxide and there is exemplified, specifically, polyalkylene oxide modified silicone such as DBE-224, DBE-621, DBE-712, DBP-732 and DBP-534 manufactured by Chisso Corporation; Tego Glide 100 manufactured by Tego Co. in Germany; and the like.

The total content of a nonionic surfactant and an amphoteric surfactant in a photosensitive composition is preferably from 0.05 to 15% by mass and more preferably from 0.1 to 5% by mass.

Furthermore, there can be added: a print-out agent for obtaining a visible image immediately after heating by exposure and a dye or a pigment as an image coloring agent.

As print-out agents, as a representative, a combination of a compound (a photo-acid releasing agent) releasing an acid by heating under exposure and organic dyes capable of forming a salt therewith, can be cited. There are exemplified, specifically, a combination of o-naphthoquinonediazide-4-sulfonic halogenide and a salt-forming organic dye described in JP-A Nos. 50-36209 and 53-8128; and a combination of a trihalomethyl compound and a salt-forming organic dye described in JP-A Nos. 53-36223, 54-74728, 60-3626, 61-143748, 61-151644 and 63-58440. As such trihalomethyl compounds, an oxazol type compound and a triazine type compound can be cited, both of which are excellent in stability with the passage of time and gives a clear print-out image.

As image coloring agents, other dyes can be used in addition to the salt-forming organic dyes described above. As preferable dyes, including salt-forming organic dyes, an oil-soluble dye and a basic dye can be cited. Specific examples include oil yellow #101, oil yellow #103, oil pink #312, oil green BG, oil blue BOS, oil blue #603, oil black BY, oil black BS, oil black T-505 (all described above being made by Orient Chemical Industries, Ltd.); victria pure blue, crystal violet, (CI42555), methyl violet (CI142535), ethyl violet, rhodamine B (CI1455170B), malachite green (CI42000), methylene blue (CI52015) and the like. Moreover, especially preferable is a dye described in JP-A No. 62-293247. These dyes can be added into a recording layer in an amount of 0.01 to 10% by mass and preferably of 0.1 to 3% by mass with respect to the total solids content in the recording layer.

A plasticizer is added into a recording layer in order to impart a flexibility to a film, if necessary. As plasticizers, the examples include oligomers or polymers of butylphthalyl, polyethylene glycol, tributyl citrate, diethylphthalate, dibutylphthalate, dihexylphthalate, dioctylphthalate, tricresylphosphate, tributyl phosphate, trioctyl phosphate, tetrahydrofurfryloleate, acrylic acid and methacrylic acid.

[Preparation of Planographic Printing Plate Precursor]

In the case where a resin composition recited in the invention is used as a recording layer of a planographic printing plate precursor, the recording layer can be prepared by coating on a proper substrate a solution obtained by dissolving the resin composition into a solvent. Furthermore, according to a purpose, a protective layer, a resin intermediate layer, a back coat layer or the like, described later, are prepared in a similar way.

The examples of solvents used here include ethylenedichloride, cyclohexanone, methylethylketone, methanol, ethanol, propanol, ethyleneglycol monomethyl ether, 1-methoxy-2-propanol, 2-methoxyethylacetate, 1-methoxy-2-propylacetate, dimethoxyethane, methyllactate, ethyllactate, N,N-dimethylacetamide, N,N-dimethylformamide, tetramethylurea, N-methylpyrrolidone, dimethylsulfoxide, sulfolan, γ-butyrolactone, toluene and the like, to which no specific limitation is imposed. The solvents described above are used either alone or in a mixture thereof.

A concentration of a component described above (in all solids content including an additive) in a solvent is preferably in the range of 1 to 50% by mass.

A coating amount (as a solids content) on a substrate obtained after coating and drying is different according to an application and, generally, is preferably in the range of 0.5 to 5.0 $g/m^2$ for a planographic printing plate precursor. As a coating amount decreases, an apparent sensitivity increases but film characteristics of a recording layer are degraded.

As coating methods, various kinds of methods can be adopted, and there is exemplified a bar coater coating, rotary coating, spray coating, curtain coating, dip coating, air knife coating, blade coating, roll coating and others.

Into a recording layer made of a resin composition recited in the invention, a surfactant for improving a coatability, for example a fluorine containing surfactant as described in JP-A No. 62-170950 can be added. A preferable addition amount is in an amount of 0.01 to 1% by mass and more preferably of 0.05 to 0.5% by mass with respect to the total solids content of a recording layer.

(Resin Intermediate Layer)

A resin intermediate layer can be provided between a substrate and a recording layer, if necessary, in a planographic printing plate precursor recited in the invention.

With a resin intermediate layer provided, the resin intermediate layer made of a polymer, between the substrate and the recording layer works as a heat insulating layer, heat generated by exposure to infrared laser light is prevented from diffusing into the substrate and efficiently used, giving advantage of realizing a high sensitivity. Furthermore, since a recording layer recited in the invention is located on an exposure surface or in the vicinity thereof even in the case where the resin intermediate layer is provided, a sensitivity to infrared laser light is maintained at a good level.

Here, it is supposed that since in an unexposed portion, the recording layer itself, which is impermeable to an alkali developing solution, works as a protective layer for the resin intermediate layer, not only does a development stability become better, but an image excellent in discrimination is also formed and stability with passage of time is improved, while in an exposed portion, components of the recording layer are quickly dissolved or dispersed into a developing solution by the release of dissolution inhibition. Furthermore, the resin intermediate layer itself, which is adjacent to the substrate, is made of an alkali-soluble polymer. Thus, the intermediate layer dissolves in the developing solution well, and even in the case where a developing solution with a lowered activity is used, the resin intermediate layer is quickly dissolved without leaving a residual film behind. Accordingly, the intermediate resin layer contributes to improvement of developability, which makes the resin intermediate layer useful.

(Substrate)

As substrates used in planographic printing plate precursor recited in the invention, any substrate can be used as far as it is a dimensionally stable plate, and satisfies requirements for physical properties such as strength, flexibility and the like, without any specific other limitation imposed thereon. The examples include a paper, a laminated paper (for example, with polyethylene, polypropylene, polystyrene and the like), a metal plate (for example, a plate made of aluminum, zinc, copper or the like), a plastic film (for example, a film made of cellulose diacetate, cellulose triacetate, cellulose propionate, cellulose lactate, cellulose acetate butyrate, cellulose nitrate, polyethylene terephthalate, polyethylene, polystyrene, polypropylene, polycarbonate, polyvinylacetal, or the like); and a paper or a plastic film laminated or metallized with such metal.

As substrates applicable to the invention, preferable are a polyester film or an aluminum plate, and especially preferable is the aluminum plate since it is better in dimensional stability and relatively inexpensive. Preferable aluminum plates are a pure aluminum plate, an alloy plate containing aluminum as a main component with a trace of a different element contained, and a plastic film laminated or metallized with aluminum. Hetero elements included in the aluminum alloy can be silicon, iron, manganese, copper, magnesium, chromium, zinc, bismuth, nickel, titanium and the like. A content of a hetero element in alloy is 10% by mass or less. Aluminum especially preferable in the invention is pure aluminum, but since absolutely pure aluminum is hard to produce because of a technical difficulty in smelting ores, the hetero elements in small amount are allowed therein.

A composition of an aluminum plate applied to the invention in this way is not specified, but aluminum plates can be properly used that have been conventionally known and used. A thickness of an aluminum plate used in the invention is approximately in the range of 0.1 mm to 0.6 mm and preferably in the range of 0.15 mm to 0.4 mm and especially preferably in the range of 0.2 mm to 0.3 mm.

Prior to surface roughening of an aluminum plate, there is conducted a degrease treatment for removing a rolling oil from surfaces thereof with, for example, a surfactant, an organic solvent, an alkaline aqueous solution or the like. A surface roughening treatment of an aluminum plate is performed with various kinds of methods and there are exemplified a method in which surface roughening is conducted mechanically, a method in which surfaces are dissolved and roughened electrochemically and a method in which surfaces are selectively dissolved chemically. As mechanical methods, there can be used known methods such as a ball polishing method, a brush polishing method, a blast polishing method, a buff polishing method and the like. As electrochemical surface roughening methods, there is available a method in which surface roughening is achieved by supply of alternate current or direct current in a hydrochloric acid electrolytic solution or a nitric acid electrolytic solution. Furthermore, a combination of the above two methods can be used as disclosed in JP-A No. 54-63902. An aluminum plate having roughened surfaces is subjected to an alkali etching treatment and a neutralization treatment, if necessary, and thereafter, further subjected to an anodic oxidation treatment, when desired, in order to enhance a water retainability and an abrasion resistance. As electrolytes used in an anodic oxidation treatment on an aluminum plate, there can be used various kinds of electrolytes each forming a porous oxide film and generally used are sulfuric acid, phophoric acid, oxalic acid, chromic acid or a mixed acid thereof. A concentration of an electrolyte described above is properly determined according to a kind of an electrolyte.

Since conditions for an anodic oxidation treatment are variously altered according to electrolytes, the conditions cannot be strictly specified as a single set of parameter ranges, but generally, proper conditions are as follows: a concentration of an electrolyte is in the range of 1 to 80% by mass relative, a temperature of the solution is in the range of from 5 to 70° C., a current density is in the range of 5 to 60 $A/dm^2$, a voltage is in the range of 1 to 100 V and an electrolysis time is in the range of 10 sec to 5 min. If a coating amount of an anodic oxidization film is less than 1.0 $g/m^2$, a printing durability is insufficient, a non-image portion of a planographic printing plate is scared with ease to easily cause a so-called "scar blemish" to be generated by attaching an ink to a portion of a scar when printing is conducted. After the anodic oxidation treatment is over, an aluminum surface is applied with a hydrophilizing treatment, if necessary. As a hydrophilizing treatment in the invention, an alkali metal silicate (for example, a sodium silicate aqueous solution) method as described in U.S. Pat. Nos. 2,714,066, 3,181,461, 3,280,734 and 3,902,734 can be cited. In this method, a substrate is subjected to an immersion treatment or to an electrolysis treatment in a sodium silicate aqueous solution. As other hydrophilizing treatments, there are used a treatment method using potassium fluorozirconate disclosed in JP-B No. 36-22063; and a treatment method using polyvinylphosphonic acid disclosed in U.S. Pat. Nos. 3,276,868, 4,153,461 and 4,689,272.

A planographic printing plate precursor recited in the invention is a plate obtained by providing a positive or negative-type recording layer on a substrate, wherein an undercoat layer can be inserted between the recording layer and the substrate, if necessary.

As components of a undercoat layer, various kinds of organic compounds can be used and there are exemplified: carboxymethylcellulose; dextrin; gum arabic; phosphonic acids each having an amino group such as 2-aminoethylphosphonic acid; organic phosphonic acids such as a phenylphophonic acid that may have a substituent; naphthylphosphonic acid, an alkylphosphonic acid, glycerophophonic acid, methylenediphosphonic acid and ethylenediphosphonic acid; organic phosphoric acids such as phenylphosphoric acid that may have a substituent, naphthylphosphoric acid, an alkylphosphoric acid and glycerophosphoric acid; organic phsphinic acids such as phenylphoshinic acid that may have a substituent, naphthylphosphinic acid, an alkylphosphinic acid and glycerophosphinic acid; amino acids such as gricine and β-alanine; and amine hydrochloric acid salts each having a hydroxygroup such as a hydrochloric acid salt of triethanolamine. They may be used singly, or a mixture of them can be used.

An organic undercoat layer can be provided in any of the following two methods. That is, in one method, a solution obtained by dissolving an organic compound described above into water or into an organic solvent such as methanol, ethanol, methylethyl ketone or the like, or into a mixed solvent thereof is coated on an aluminum plate, then a coat on the aluminum plate is dried to form an undercoat layer and in the other method, an aluminum plate is immersed into a solution obtained by dissolving an organic compound described above into water or into an organic solvent such as methanol, ethanol, methylethyl ketone or the like, or into a mixed solvent thereof to cause the organic compound to be adsorbed on the aluminum plate, followed by cleaning with water or the like and drying to form an organic undercoat layer. In the former method, a solution containing an organic compound described above in an amount of 0.005 to 10% by mass can be applied with various methods. On the other hand, in the latter method, a concentration in a solution is in the range of from 0.01 to 20% by mass and preferably in the range of from 0.05 to 5% by mass, an immersion temperature is in the range of from 20 to 90° C. and preferably in the range of 25 to 50° C. and an immersion time is in the range of 0.1 sec to 20 min and preferably in the range of 2 sec to 1 min. A pH value of a solution can also be adjusted in the range of 1 to 12 with a basic material such as ammonia, triethylamine, potassium hydroxide or the like, and an acidic material such as hydrochloric acid, phosphoric acid or the like. Furthermore, an yellow dye can also be added in order to improve a tone reproducibility of an image recording material.

A coating amount of an organic undercoat layer is properly in the range of 2 to 200 $mg/m^2$ and preferably in the range of 5 to 100 $mg/m^2$. If the coating amount is less than 2 $mg/m^2$, a sufficient printing durability is not obtained. On the other hand, if the coating amount is more than 200 $mg/m^2$, a result is the same as the case of the coating amount less than 2 $mg/m^2$.

A planographic printing plate precursor prepared in a way described above is usually subjected to imagewise exposure and a development.

As a light source of light used in imagewise exposure, preferable is a light source having light emission wavelengths in a region of near infrared to infrared and especially preferable is a solid laser or a semiconductor laser.

As a developing solution and a replenishing solution for a planographic printing plate precursor using a resin composition recited in the invention as a recording layer, there can be used an alkali aqueous solution having been known conventionally.

There are exemplified: inorganic alkali salts such as sodium silicate, potassium silicate; sodium tertiary phosphate, potassium tertiary phosphate, ammonium tertiary phosphate; sodium secondary phosphate, potassium secondary phosphate, ammonium secondary phosphate; sodium carbonate, potassium carbonate, ammonium carbonate; sodium bicarbonate, potassium bicarbonate, ammonium bicarbonate; sodium borate, potassium borate, ammonium borate; sodium hydroxide, ammonium hydroxide, potassium hydroxide, a lithium hydroxide and the like. Furthermore, there are also used organic alkali agents such as monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine, pyridine and the like. The alkali agents described above are used either alone or in combination of two or more kinds of them.

Especially preferable developing solutions among the alkali agents described above are aqueous solutions of silicic acid salts such as sodium silicate, potassium silicate and the like. This is because a developability can be adjusted by altering a ratio and concentrations of silicon oxide $SiO_2$ and an alkali metal oxide $M_2O$, which are components of a silicic acid salt, and effectively used are, for example, an alkali metal silicate salt as described in JP-A No. 54-62004 and JP-B No. 57-7427.

It has been known that in the case where development is conducted by an automatic processor, an aqueous solution (a replenishing solution) higher in alkaline strength than a developing solution is added into the developing solution to thereby enable many of PS plates to be treated with the developing solution contained in a development tank for a long time without exchanging the existing development solution to a new one. In the invention as well, this way of replenishing is preferably applied. Various kinds of surfactants and various kinds of organic solvents can be added to a developing solution and a replenishing solution thereof, if necessary, for the purpose to enhance or inhibit developability, to disperse development sediment and to enhance the ink-affinity of a image portion of a printing plate.

As preferable surfactants, an anionic surfactant, a cationic surfactant, a nonionic surfactant, and an amphoteric surfactant can be cited. Furthermore, reducing agents such as hydroqinone, resorcinol, sodium salts or potassium salts of inorganic acids including sulfurous acid, hydrogensulfurous acid and the like can be added. Further, an organic carboxylic acid, an antiformer and a water softner can be added.

A printing plate having received a development treatment using a developing solution and a replenishing solution described above is further subjected to a post treatment with a rinse solution including washing water, a surfactant and the like, and a desensitizing solution including gum arabic and a starch derivative. The treatments described above are used in various combinations as post treatments when a resin composition recited in the invention is used as a planographic printing plate.

In recent years, an automatic processor for a printing plate has been widely used for rationalization and standardization in plate-making in the plate-making and printing industries. The automatic processor generally includes a developing section and a post treatment section, and is constituted of a device transporting a printing plate, treatment solution baths and a spray device, wherein a printing plate after exposure is transported horizontally and the treatment solutions raised by pumps are blown through spray nozzles onto the printing plate to perform a developing treatment. Furthermore, a method has also been recently known in which a printing plate is immersed and transported in treatment baths filled with respective treatment solutions with the help of submerged guide rolls or the like. In such an automatic treatment, treatments can be performed while replenishing treatment solutions with replenishing solutions according to a treated amount or a working time. Furthermore, also applicable in such an automatic treatment is a so-called disposable solution treatment scheme in which treatments are conducted with substantially unused treatment solutions.

In a planographic printing plate precursor recited in the invention, if there exists an unnecessary image portion (for example a film edge mark of an original picture film) on a planographic printing plate obtained after a procedure of imagewise exposure, development, water washing and/or rinsing and/or gumming, erasure of the unnecessary image portion is performed. Such an erasure is preferably conducted in a method in which an erasing solution as described in, for example, JP-B No. 2-13293 is coated on the unnecessary image portion and the plate is left as it is for a predetermined time, followed by water washing, whereas another method can also be used in which an unnecessary image portion is irradiated with active light guided through an optical fiber before development as described in JP-A No. 59-174842.

It is possible that a planographic printing plate prepared in a manner described above is coated with desensitizing gum if necessary and thereafter transferred to a printing process, but if it is desired to obtain a planographic printing plate with a higher printing durability, a baking treatment is applied thereto when desired.

In the case where a planographic printing plate is baked, it is preferable to treat the plate with a surface conditioner as described in JP-B Nos. 61-2518, 55-28062, JP-A Nos. 62-31859 and 61-159655.

As methods of applying the surface conditioner, there are available a method in which the surface conditioner is coated on a planographic printing plate with sponge or absorbent cotton soaked with the solution, a method in which a printing plate is immersed in the surface conditioner held in a vat for coating and a method coating with an automatic coater. Furthermore, a coating amount is made uniform using a squeeze or a squeezing roller after the coating to give a preferable result.

Generally, a coating amount of a surface conditioner is properly in the range of 0.03 to 0.8 $g/m^2$ (dry mass). A planographic printing plate on which a surface conditioner is coated is heated to a high temperature with a baking processor (for example, sold by Fuji Photo Film Co., Ltd. with a trade name "BP-1300") or the like after the drying, if necessary. A heating temperature and a heating time in this treatment is preferably in the range of 180 to 300° C. and in the range of from 1 to 20 min, respectively though depending on the kind of the component forming the image.

A planographic printing plate after a baking treatment can be subjected to conventional treatments, such as water washing, gumming and the like, if necessary. In the case where the plate is applied with a surface conditioner containing a water-soluble high molecular compound or the like, a so-called desensitizing treatment such as gumming can be omitted. A planographic printing plate obtained through such treatments is used in an offset printing machine or the like to perform printing of a number of sheets.

EXAMPLES

Detailed description will be given of the present invention using examples below, but the invention is not limited to the examples. In the examples of this application, evaluations are performed on planographic printing plate precursors using resin compositions recited in the invention as recording layers, and the results are regarded as evaluations on the resin compositions recited in the invention.

[Preparation of Substrate]

Aluminum plates according to JIS-A-1050 of 0.3 mm in thickness were used and subjected to combinations of the following steps to prepare substrates A, B, C and D.

(a) Mechanical Surface Roughening Treatment

Mechanical surface roughening was performed in a way that a water suspension containing a polishing agent (siliceous sand) having specific gravity of 1.12 was fed as a polishing slurry on a surface of an aluminum plate and in this state, mechanical surface roughening was performed with a rotating roller type nylon brush. An average particle diameter of the polishing agent was 8 μm and the maximum particle diameter was 50 μm. The nylon brush was equipped with bristles of 6.10 nylon having a bristle length of 50 mm and a bristle diameter of 0.3 mm. The nylon brush was prepared by attaching bristles on a stainless cylinder of 300 mmϕ in diameter so as to densely insert them in holes formed on the surface of the cylinder. Three rotary brushes were used. A distance between two supporting rollers (200 mm in diameter) in the lower section of the brush assembly was 300 mm. A load imposed on a driving motor rotating the brush roller was increased to more than an initial load (before the brush roller was pressed onto the aluminum plate) by 7 kW, by pressing the brush roller to the aluminum plate. The rotation direction of the brushes were the same as a moving direction of the aluminum plate. A rotation rate of the roller brush was 200 rpm.

(b) Alkali Etching Treatment

The aluminum plate obtained through the above process was subjected to an etching treatment in which the aluminum plate was sprayed with a NaOH aqueous solution (at a concentration of 26% by mass with an aluminum ion concentration of 6.5% by mass) at a temperature of 70° C. to dissolve the aluminum plate at an amount of 6 g/m$^2$. Thereafter, water washing was performed on the aluminum plate with a spray of well water.

(c) Desmutting Treatment

A desmutting treatment was conducted with a spray of 1% by mass aqueous solution of nitric acid (containing an aluminum ion at a concentration of 0.5% by mass) at a temperature of 30° C., followed by water spray washing. The nitric acid aqueous solution used in the desmutting was a waste solution discharged in a step of elecrochemical surface roughening with an alternating current in a nitric acid aqueous solution.

(d) Electrochemical Surface Roughening Treatment

An aluminum plate was subjected to a continuous surface roughening treatment using an alternating current voltage of 60 Hz. An electrolytic solution at this time was a nitric aqueous acid solution at a concentration of 10.5 g/l (containing an aluminum ion at a concentration of 5 g/l) at a temperature of 50° C. An alternating current was such that in a waveform, a time TP required from a current value of zero till it reaches its peak value was 0.8 msec and a DUTY ratio was 1 to 1; and the wave form was of a rectangular, to be exact a trapezoidal, and an electrochemical surface roughening treatment was conducted using the alternating current with a carbon electrode as the opposite electrode. An auxiliary anode was of ferrite. An electrolytic bath was of a radial cell type.

The current density was 30 A/dm$^2$ at its peak and a total current amount was 220 C/dm$^2$ when the aluminum plate works as an anode. 5% of a current flowing out from a power supply was diverted into the auxiliary electrode.

Thereafter, the aluminum plate was water washed with a spray of well water.

(e) Alkali Etching Treatment

An aluminum plate was subjected to an etching treatment at 32° C. with a spray of a sodium hydroxide aqueous solution at a concentration of 26% by mass including an aluminum ion at a concentration of 6.5% by mass to dissolve the aluminum plate in an amount of 0.20 g/m$^2$ and to remove a smut component composed of aluminum hydroxide as a main component, produced when electrochemical surface roughening was performed using an alternating current at a previous stage and to smooth out edge portions of generated pits by dissolving the portions. Thereafter, water washing was conducted using a spray of well water.

(f) Desmutting Treatment

An aluminum plate was subjected to a desmutting treatment with a spray of a sulfuric acid aqueous solution at a concentration of 15% by mass (containing an aluminum ion at a concentration of 4.5% by mass) at a temperature of 30° C., followed by water washing with a spray of well water. The nitric acid aqueous solution used in the desmutting treatment was a waste solution discharged in an electrochemical surface roughening step using an alternating current in a nitric acid aqueous solution.

(g) Electrochemical Surface Roughening Treatment

An aluminum plate was subjected to a continuous electrochemical surface roughening treatment using an alternate current voltage of 60 Hz. An electrolytic solution used here was an hydrochloric acid aqueous solution at a concentration of 7.5 g/l (containing an aluminum ion at a concentration of 5 g/l) at a temperature of 35° C. An alternating current waveform was of a rectangular shape, and an electrochemical surface roughening treatment was conducted with a carbon electrode as the opposite electrode. An auxiliary anode was of ferrite. An electrolytic bath was of a radial cell type.

A current density was 25 A/dm$^2$ at its peak and a total current amount was 50 C/dm$^2$ as the sum of the quantity of the electricity when the cathode was an aluminum plate.

Thereafter, the aluminum plate was water washed with a spray of well water.

(h) Alkali Etching Treatment

An aluminum plate was subjected to an etching treatment with a spray of a sodium hydroxide aqueous solution at a concentration of 26% by mass including an aluminum ion at a concentration of 6.5% by mass at 32° C. to dissolve the aluminum plate at an amount of 0.10 g/m$^2$, to remove a smut component composed of aluminum hydroxide as a main component, produced when electrochemical surface roughening was conducted using an alternating current at a previous stage and to smooth out edge portions of generated pits by dissolving the portions. Thereafter, water washing was conducted using a spray of well water.

(i) Desmutting Treatment

The aluminum plate was subjected to a desmutting treatment with spray of a sulfuric acid aqueous solution at a concentration of 25% by mass (containing an aluminum ion at a concentration of 0.5% by mass) at a temperature of 60° C., followed by water washing with a spray of well water.

(j) Anodic Oxidation Treatment

A sulfuric acid was used in electrolytic solutions. Any of the electrolytic solutions contains sulfuric acid at a concentration of 170 g/l (containing an aluminum ion at a concentration of 0.5% by mass) at a temperature of 43° C. Thereafter, water washing was conducted using a spray of well water.

Current densities were all about 30 A/dm$^2$. A final oxide film amount was 2.7 g/m$^2$.

<Substrate A>

The above steps (a) to (j) were sequentially performed in the order to prepare a substrate in which an etching amount in the step (e) was 3.4 g/m$^2$.

<Substrate B>

The above steps were sequentially performed in the order with the exception that the steps (g), (h) and (i) were omitted, to prepare a substrate.

<Substrate C>

The above steps were sequentially performed in the order with the exception that the steps (a), (g), (h) and (i) were omitted, to prepare a substrate.

<Substrate D>

The above steps were sequentially performed in the order with the exception that the steps (a), (d), (e) and (f) were omitted, to prepare a substrate, in which a total current amount in the step (g) was 450 C/dm$^2$.

The substrates A, B, C and D prepared as described above were subjected to the following hydrophilizing treatment and undercoat treatment subsequent to the above steps.

(k) Alkali Metal Silicic Acid Salt Treatment

An aluminum substrate obtained by an anodic oxidation treatment was immersed into a sodium silicate No. 3 aqueous solution at a concentration of 1% by mass at a temperature of 30° C. for 10 sec, thereby performing an alkali metal silicic acid salt treatment (silicate treatment) on the substrate. Thereafter, water washing was conducted using a spray of well water. An attachment amount of silicate at this time was 3.6 mg/m$^2$.

(Undercoat Treatment)

An undercoat solution of the following composition was coated on the aluminum substrate obtained as described above after the alkali metal silicic acid salt treatment, and dried at 80° C. for 15 sec. The coating amount after the drying was 15 mg/m$^2$.

| <Undercoat Solution Composition> | |
|---|---|
| following high molecular compound | 0.3 g |
| methanol | 100 g |
| water | 1.0 g |

High molecular compound

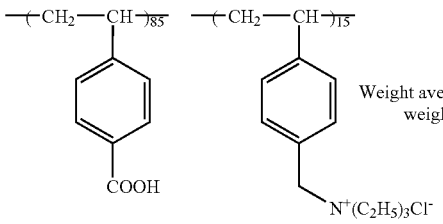

Weight average molecular weight 28,000

Examples 1 to 12 and Comparative Examples 1 and 2

The following coating solution for an image recording layer was coated on the obtained substrate and the substrate with a coat thereon was dried in an oven at 150° C. for 1 min to prepare a planographic printing plate precursor having a positive-type image recording layer with a dry film thickness of 1.8 g/m$^2$.

| <Coating Solution 1 for Image Recording Layer> | |
|---|---|
| thiol compound (C) described in Table 1 | the amount described in Table 1 |

-continued

| <Coating Solution 1 for Image Recording Layer> | |
|---|---|
| m,p-cresol novolak (m/p ratio = 6/4, a weight average molecular weight 7,700 and unreacted cresol contained at 0.5% by mass) | 0.94 g |
| n-butyl methacrylate-methacrylic acid copolymer (mole ratio = 73:27, weight average molecular weight 51,000) | 0.06 g |
| following infrared absorbing agent (cyanine dye A) | 0.03 g |
| following infrared absorbing agent (cyanine dye B) | 0.01 g |
| 2,4,6-tris(hexyloxy)benzenediazonium-2-hydroxy-4-methoxybenzophenone-5-sulfonate | 0.01 g |
| p-toluenesulfonic acid | 0.002 g |
| dye obtained by changing the couter-anion of victoria pure blue BOH to 1-naphthalenesulfonic anion | 0.015 g |
| fluorine-type surfactant (trade name: MEGAFACE F-780 manufactured by Dainippon Ink and Chemicals) | 0.02 g |
| methylethylketone | 17 g |
| 1-methoxy-2-propanol | 5 g |

Cyanine dye A

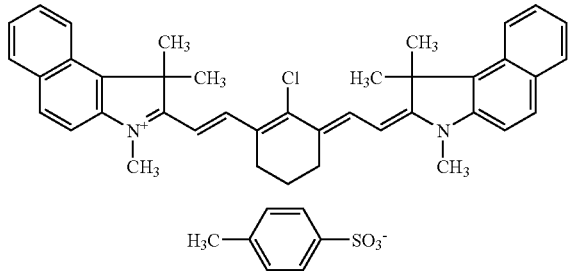

Cyanine dye B

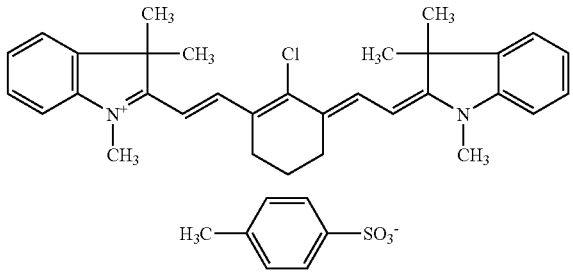

[Evaluation on Development Latitude]

The obtained planographic printing plate precursor was stored in the condition of a temperature of 25° C. and a relative humidity of 50% for 5 days and thereafter, a test pattern was imagewise written on the precursor with Trendsetter 3244 manufactured by Creo Co. at a beam strength of 9.0 W and a drum rotational rate of 150 rpm.

Thereafter, a conductivity of an alkali developing solution was altered by adjusting a water amount in the alkali developing solution of the following composition A or B, to select a dilution rate, and each of the alkali developing solutions thus obtained with various conductivities was loaded into a PS processor 900H manufactured by Fuji Photo Film Co., Ltd. to perform development of a patterned plate at a developing time of 20 sec while maintaining the temperature of the solution at 30° C. A difference between the highest conductivity and lowest conductivity of developing solutions with which a good development was performed without dissolving an image portion and without a smudge or coloration caused by a residual film of the recording layer caused by poor development, was evaluated as development latitude. As the difference increases, the development latitude becomes more excellent, thereby an image more excellent in contrast can be formed. Results are shown in Table 1.

| <Alkali Developing Solution Composition A> | |
|---|---|
| $SiO_2.K_2O$ ($K_2O/SiO_2$ = 1/1 (molar ratio) | 4.0% by mass |
| citric acid | 0.5% by mass |
| polyethyleneglycol lauryl ether (weight average molecular weight 1,000) | 0.5% by mass |
| water | 95.0% by mass |
| <Alkali Developing Solution Composition B> | |
| D sorbit | 2.5% by mass |
| sodium hydroxide | 0.85% by mass |
| polyethyleneglycol lauryl ether (weight average molecular weight 1,000) | 0.5% by mass |
| water | 96.15% by mass |

[Evaluation on Sensitivity]

A test pattern was imagewise written on the obtained planographic printing plate precursors with Trendsetter 3244 manufactured by Creo Co. at various exposure energy values. Thereafter, development was performed with an alkali developing solution having a conductivity of an intermediate value (average value) between the highest conductivity and the lowest conductivity of developing solutions with which a good development was performed without dissolving an image portion and without a smudge or coloration caused by a residual film of the recording layer caused by poor development, which conductivities are also described in the foregoing evaluation of a development latitude. And measurement of the exposure amount (a beam strength at a drum rotational rate of 150 rpm) with which an non-image portion can be developed with the alkali developing solution having said intermediate conductivity, was conducted and the measured exposure amount was assumed as the sensitivity. A lower exposure amount was evaluated as a higher sensitivity.

As is apparent from Table 1, it is confirmed that planographic printing plate precursors of Examples 1 to 12 using resin compositions containing thiol compounds (C) recited in the invention in the recording layers are excellent in latitude and sensitivity in any of cases where a silicate based developing solution and a non-silicate based developing solution are used.

On the other hand, it is confirmed that the planographic printing plate precursor of Comparative Example 1 not using thiol compound (C) recited in the invention as a component of the recording layer is lower in any of latitude and sensitivity; and the planographic printing plate precursor of Comparative Example 2 using p-acetylphenol instead of a thiol compound (C) as an additive in the recording layer is lower in latitude though no difference is observed in sensitivity.

Examples 13 to 16

The above undercoat solution was coated on the obtained substrates B and D in a way similar to that adopted in Examples 1 to 12, thereafter, a lower layer coating solution of the following composition was coated on the substrates B and D with a wire bar giving the wet coating amount of 28 ml/m$^2$ to obtain a coating amount of 1.5 g/m$^2$, followed by drying in a drying oven at 150° C. for 60 sec.

An image recording layer (upper layer) coating solution 2 of the following composition was coated on the obtained substrates each with a lower layer, with a wire bar giving the wet coating amount of 11 ml/m$^2$ so as to obtain the total coating amount of 1.8 g/m$^2$. After the coating, the substrates with the layers were dried in a dry oven at 140° C. for 70 sec to prepare positive-type planographic printing plate precursors.

| <Lower Layer Coating Solution> | |
|---|---|
| thiol compound (C) described in Table 2 | the amount described in Table 2 |

TABLE 1

| | | Thiol compounds (C) | | Development latitude (mS/cm) | | Sensitivity (W) | |
|---|---|---|---|---|---|---|---|
| | Substrates | Compounds | Amount (g) | Developing solution A | Developing solution B | Developing solution A | Developing solution B |
| Example 1 | A | T-6 | 0.04 | 5 | 5 | 5.5 | 6.0 |
| Example 2 | B | T-16 | 0.03 | 5 | 6 | 5.5 | 5.5 |
| Example 3 | C | T-24 | 0.05 | 6 | 6 | 5.0 | 5.5 |
| Example 4 | D | T-30 | 0.05 | 6 | 7 | 5.5 | 5.5 |
| Example 5 | B | T-53 | 0.05 | 6 | 6 | 5.5 | 5.5 |
| Example 6 | C | T-62 | 0.06 | 5 | 6 | 5.5 | 5.5 |
| Example 7 | B | T-83 | 0.05 | 6 | 7 | 5.5 | 5.5 |
| Example 8 | B | T-88 | 0.05 | 6 | 7 | 5.5 | 5.0 |
| Example 9 | B | T-90 | 0.05 | 7 | 7 | 5.0 | 5.0 |
| Example 10 | B | T-92 | 0.06 | 6 | 7 | 5.0 | 5.0 |
| Example 11 | D | T-98 | 0.06 | 7 | 7 | 5.0 | 5.5 |
| Example 12 | B | T-104 | 0.05 | 6 | 7 | 5.0 | 5.0 |
| Comparative Example 1 | B | — | 0 | 3 | 3 | 7.5 | 7.0 |
| Comparative Example 2 | B | T-C | 0.06 | 3 | 4 | 5.0 | 5.5 |

T-C: p-acetylphenol

-continued

| | |
|---|---|
| copolymer of N-(p-aminosulfonylphenyl)methacrylamide, methyl methacrylate and acrylilonitril (molar ratio = 37:33:30, weight average molecular weight 64,000) | 2.133 g |
| cyanine dye A (of the above structure) | 0.098 g |
| cyclohexanedicarboxylic anhydride | 0.100 g |
| bis(hydroxymethyl)-p-cresol | 0.090 g |
| p-toluenesulfonic acid | 0.012 g |
| compound obtained by changing the counter anion of ethylviolet to 6-hydroxynaphthalenesulfonic acid | 0.100 g |
| 3-methoxy-4-diazodiphenylamine hexafluorophophate (thermally decomposable compound) | 0.03 g |
| fluorine containing surfactant (trade name: MEGAFACE F-780 manufactured by Dainippon Ink and Chemicals, Incorporated) | 0.035 g |
| methylethylketone | 26.6 g |
| 1-methoxy-2-propanol | 13.6 g |
| N,N-dimethylacetamide | 13.8 g |
| <Image Recording Layer (Upper layer) Coating Solution> | |
| copolymer of isobutylmethacrylate-methacrylic acid (mole ratio = 73:27, weight average molecular weight 49,000) | 0.040 g |
| cresol-novolak resin (trade name: PR-54046 manufactured by Sumitomo Bakelite Co., Ltd.) | 0.32 g |
| cyanine dye C (of the following structure) | 0.008 g |
| tetrabutylammonium bromide | 0.030 g |
| fluorine-type surfactant (trade name: MEGAFACE F-780 manufactured by Dainippon Ink and Chemicals, Incorporated) | 0.035 g |
| 1-methoxy-2-propanol | 40.2 g |

Cyanine dye C

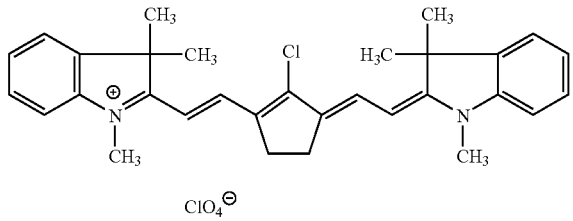

[Evaluation on Development Latitude and Sensitivity]

Exposure and development were performed in a similar way to the way adopted in Examples 1 to 12 with the exception that the developing solution was changed to a developing solution DT-1 manufactured by Fuji Photo Film Co., Ltd., developing time was changed to 14 sec, and evaluations were performed on development latitude and sensitivity. Results are shown in Table 2.

TABLE 2

| | Substrates | Thiol compounds (C) Compounds | Thiol compounds (C) Amount (g) | Development latitude (ms/cm) | Sensitivity (W) |
|---|---|---|---|---|---|
| Example 13 | B | T-94 | 0.12 | 6 | 5.0 |
| Example 14 | B | T-98 | 0.13 | 5 | 5.0 |
| Example 15 | D | T-61 | 0.13 | 5 | 5.5 |
| Example 16 | C | T-91 | 0.10 | 6 | 5.0 |

As is clear from Table 2, it is confirmed that planographic printing plate precursors of Examples 13 to 16 using resin compositions recited in the invention as recording layers thereon, even in the case where a recording layer is of a multilayer structure, are excellent in development latitude and sensitivity and exert an effect similar to a recording layer of a single layer structure.

Examples 17 to 19

After the above undercoat solution was coated on the obtained substrates B, C and D in a similar way to the way adopted in Examples 1 to 12, an image recording layer coating solution 3 of the following composition was coated thereon giving a wet coating amount of 19 cc/$m^2$ with a wire bar, followed by drying to obtain planographic printing plate precursors.

| <Image Recording Layer Coating Solution 3> | |
|---|---|
| thiol compound (C) described in Table 3 | the amount described in Table 3 |
| copolymer of N-(p-aminosulfonylphenyl)methacrylamide, methyl methacrylate and acrylonitril (molar ratio 37:33:30, weight average molecular weight 64,000) | 2.370 g |
| cresol novolak (trade name: PR-54046 manufactured by Sumitomo Bakelite Co., Ltd.) | 0.474 g |
| cyanine dye A (of the above structure) | 0.109 g |
| tetrahydrophthalic anhydride | 0.190 g |
| p-toluenesulfonic acid | 0.008 g |
| compound obtained by changing the counter anion of ethylviolet to 6-hydroxynaphthalenesulfonic acid | 0.100 g |
| dimyristyl 3,3'-thiodipropionate | 0.030 g |
| di-n-dodecyl 3,3'-thiodipropionate | 0.030 g |
| fluorine-type surfactant (trade name: MEGAFACE F-780 manufactured by Dainippon Ink and Chemicals, Incorporated) | 0.035 g |
| fluorine-type surfactant (trade name: Defensa MCF-312 manufactured by Dainippon Ink and Chemicals, Incorporated) | 0.035 g |
| methylethylketone | 26.6 g |
| 1-methoxy-2-propanol | 13.6 g |
| N,N-dimethylacetamide | 13.8 g |

[Evaluation on Development Latitude and Sensitivity]

Exposure and development were performed in a similar way to the way adopted in Examples 13 to 16 on the obtained planographic printing plate precursors and evaluations were performed on development latitude and sensitivity. Results are shown in Table 3.

TABLE 3

| | Substrates | Thiol compounds (C) Compounds | Thiol compounds (C) Amount (g) | Development latitude (ms/cm) | Sensitivity (W) |
|---|---|---|---|---|---|
| Example 17 | B | T-74 | 0.14 | 7 | 4.5 |
| Example 18 | C | T-95 | 0.16 | 6 | 5.0 |
| Example 19 | D | T-8 | 0.12 | 6 | 5.0 |

As is clear from Table 3, it is confirmed that planographic printing plate precursors of Examples 17 to 19 using resin compositions containing thiol compounds (C) recited in the invention in the recording layers are excellent in development latitude and sensitivity even in the case where an acrylic based polymer is used as a main component of an alkali-soluble resin.

As mentioned above, according to the examples, it is confirmed that the resin composition recited in the invention is useful for a recording layer of a planographic printing plate precursor compatible to exposure with infrared ray.

According to the invention, by performing recording using a solid laser or a semiconductor laser radiating infrared ray, there can be obtained a resin composition useful for a recording layer of a planographic printing plate precursor, capable of direct plate-making based on digital data of a computer or the like therewith, and capable of forming an image excellent in contrast therewith.

What is claimed is:

1. A resin composition comprising:

(A) an alkali-soluble resin;

(B) an infrared absorbing agent having a maximum absorption wavelength in the range of 760 nm to 1200 nm; and (C) a thiol compound, wherein a solubility of the resin composition in an alkaline aqueous solution is changed by exposure with an infrared laser beam.

2. A resin composition according to claim 1, further comprising:

(D) a compound that is thermally decomposable and substantially reduces a solubility of the alkali-soluble resin in an undecomposed state.

3. A resin composition according to claim 2, wherein the compound that is thermally decomposable and substantially reduces a solubility of the alkali-soluble resin in an undecomposed state is a compound selected from a group consisting of onium salts, o-quinonediazide compounds, and alkyl sulfonate esters.

4. A resin composition according to claim 1, wherein the thiol compound can tautomerize as shown by the following general formula (1):

General formula (1)

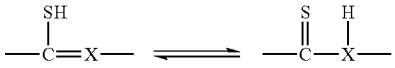

wherein X represents a trivalent atom or atomic group.

5. A resin composition according to claim 4, wherein X in general formula (1) is a nitrogen atom or a methine group.

6. A resin composition according to claim 1, wherein the thiol compound is an aliphatic hydrocarbon having an SH group on a side chain or at a terminal.

7. A resin composition according to claim 1, wherein the thiol compound is a cyclic hydrocarbon substituted by an SH group or a heterocyclic compound substituted by an SH group.

8. A resin composition according to claim 7, wherein the cyclic hydrocarbon substituted by an SH group is a compound represented by the following general formula:

General formula

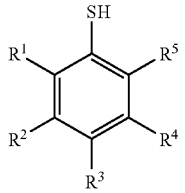

wherein in the general formula, $R^1$ through $R^5$ each independently represent a hydrogen atom, an alkyl group, a halogen atom, an alkoxy group, or a mercapto group.

9. A resin composition according to claim 7, wherein the heterocyclic compound substituted by an SH group has two nitrogen atoms in the heterocyclic compound and is represented by the following general formula:

General formula

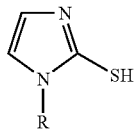

wherein in the general formula, R represents a hydrogen atom or an alkyl group.

10. A resin composition according to claim 7, wherein the heterocyclic compound substituted by an SH group has three nitrogen atoms in the heterocyclic compound and is represented by at least one of the following general formulae:

General formulae

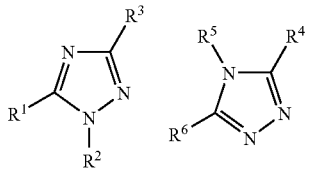

wherein in the general formulae, $R^1$ through $R^6$ each independently represent a hydrogen atom, an alkyl group, an aryl group, an amino group, or a mercapto group, at least one of $R^1$ and $R^3$ represents a mercapto group, and at least one of $R^4$ and $R^6$ represents a mercapto group.

11. A resin composition according to claim 7, wherein the heterocyclic compound substituted by an SH group has four nitrogen atoms in the heterocyclic compound and is represented by the following general formula:

General formula

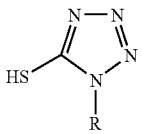

wherein in the general formula, R represent an alkyl group or an aryl group, and when R represents an aryl group, R may represent an aryl group that has a substituent selected from the group consisting of a hydroxyl group, a carbamoyl group, and a carboxyl group.

12. A resin composition according to claim 7, wherein the heterocyclic compound substituted by an SH group is a compound represented by the following general formula:

General formula

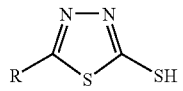

wherein in general formula, R represents an alkyl group, an amino group, an alkylthio group, or a mercapto group.

13. A resin composition according to claim 7, wherein the heterocyclic compound substituted by an SH group is a compound represented by the following general formula:

General formula

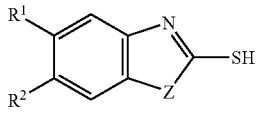

wherein in general formula, $R^1$ and $R^2$ each independently represent a hydrogen atom, an alkyl group, an alkoxy group, a halogen atom, a carbamoyl group, a nitro group, or a sulfonate group, and Z represents —NH—, an oxygen atom, or a sulfur atom.

14. A resin composition according to claim 7, wherein the heterocyclic compound substituted by an SH group is a compound represented by the following general formula:

General formula

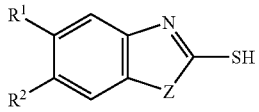

wherein in the general formula, $R^1$ and $R^2$ each independently represent a hydrogen atom, an alkyl group, an alkoxy group, a halogen atom, a carbamoyl group, a nitro group, or a sulfonate group, and Z represents an oxygen atom or a sulfur atom.

15. A resin composition according to claim 7, wherein the heterocyclic compound substituted by an SH group is a compound represented by the following formula:

General formula

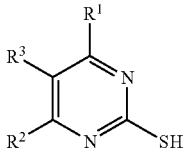

wherein in the general formula, $R^1$ through $R^3$ each independently represent a hydrogen atom, an alkyl group, a haloalkyl group, a hydroxyl group, an amino group, a nitroso group, or a mercapto group.

16. A resin composition according to claim 1, wherein the thiol compound is a compound obtained by substituting an SH group for a substituent on a cyclic hydrocarbon.

17. A resin composition according to claim 1, wherein the thiol compound is contained in an amount of 0.2 to 20% by mass based on a total solids content of the resin composition.

18. A resin composition according to claim 1, wherein the resin composition is a resin composition for a positive-type planographic printing plate precursor.

19. A positive-type image recording layer containing a resin composition according to claim 1.

20. A positive-type image recording layer according to claim 19, wherein the thiol compound can tautomerize as shown by the following general formula (1):

General formula (1)

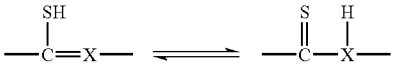

wherein X represents a trivalent atom or atomic group.

21. A negative-type image recording layer containing a resin composition according to claim 1.

* * * * *